US011243491B1

(12) United States Patent
Kamiya et al.

(10) Patent No.: US 11,243,491 B1
(45) Date of Patent: Feb. 8, 2022

(54) FIXING DEVICE AND IMAGE FORMING APPARATUS

(71) Applicant: FUJIFILM Business Innovation Corp., Tokyo (JP)

(72) Inventors: Shogo Kamiya, Kanagawa (JP); Hiroaki Okuma, Kanagawa (JP); Shingo Akiyama, Kanagawa (JP); Masakatsu Eda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/146,616

(22) Filed: Jan. 12, 2021

(30) Foreign Application Priority Data

Sep. 24, 2020 (JP) ..... JP2020-159393

(51) Int. Cl.
*G03G 15/00* (2006.01)
*G03G 15/20* (2006.01)

(52) U.S. Cl.
CPC ..... *G03G 15/6576* (2013.01); *G03G 15/2028* (2013.01)

(58) Field of Classification Search
CPC ..... G03G 15/2017; G03G 15/2028; G03G 15/2032; G03G 15/2035; G03G 15/6576; G03G 21/1619; G03G 2215/00662; G03G 2221/1678; G03G 2221/1687
See application file for complete search history.

(56) References Cited

U.S. PATENT DOCUMENTS

2014/0126945 A1* 5/2014 Uchida ..... G03G 21/1685 399/406

FOREIGN PATENT DOCUMENTS

JP 2016-164644 A 9/2016

* cited by examiner

*Primary Examiner* — Thomas S Giampaolo, II
(74) *Attorney, Agent, or Firm* — Sughrue Mion, PLLC

(57) ABSTRACT

A fixing device includes a device body, a fixing unit, a pair of decurling units, and an open/close unit. The fixing unit is disposed on the device body to perform a fixing operation on a recording medium, and includes a removal assistance unit to assist removal of the recording medium. The pair of decurling units are disposed on the device body to correct a curl of the recording medium by holding the recording medium therebetween. The open/close unit is openably and closeably disposed on the device body to separate, when opened, the removal assistance unit from the fixing unit and one of the decurling units from the other decurling unit.

8 Claims, 14 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2020-159393 filed Sep. 24, 2020.

BACKGROUND

(i) Technical Field

The present disclosure relates to a fixing device and an image forming apparatus.

(ii) Related Art

Examples of an existing technology relating to an image forming apparatus including a fixing device include a device disclosed in Japanese Unexamined Patent Application Publication No. 2016-164644.

Japanese Unexamined Patent Application Publication No. 2016-164644 has a structure including a fixing device that fixes a toner image onto a recording medium, and a decurler disposed downstream from the fixing device in a recording-medium transport direction to correct curling of a recording medium to which a toner image has been fixed by the fixing device.

SUMMARY

Aspects of non-limiting embodiments of the present disclosure relate to a fixing device integrally including a decurling unit and a fixing unit including a removal assistance unit, the fixing device improving removal of a recording medium causing a transport error.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device that includes a device body, a fixing unit, a pair of decurling units, and an open/close unit. The fixing unit is disposed on the device body to perform a fixing operation on a recording medium, and includes a removal assistance unit to assist removal of the recording medium. The pair of decurling units are disposed on the device body to correct a curl of the recording medium by holding the recording medium therebetween. The open/close unit is openably and closeably disposed on the device body to separate, when opened, the removal assistance unit from the fixing unit and one of the decurling units from the other decurling unit.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described with reference to the drawings, below.

Exemplary Embodiment 1

Figure 1:
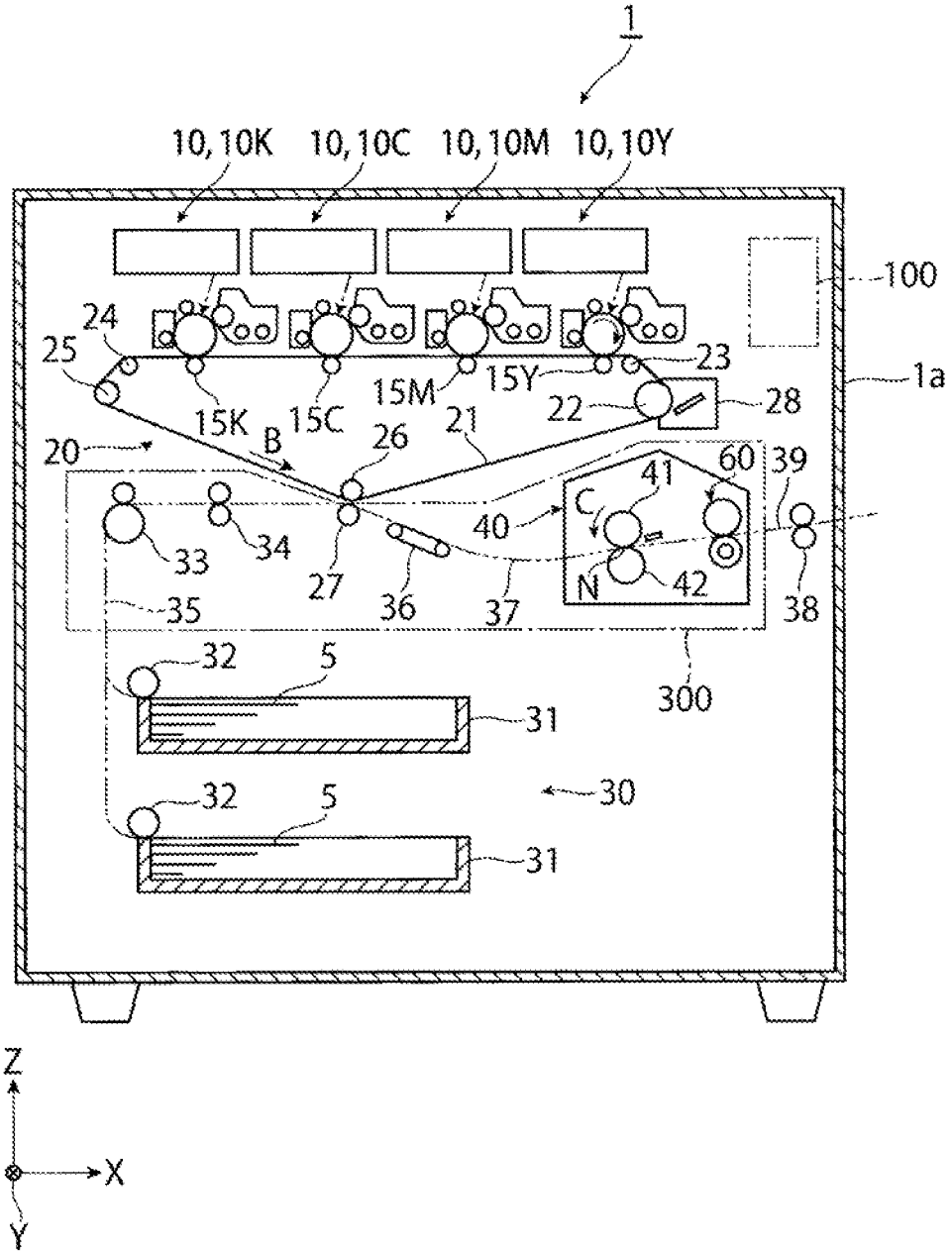
FIG. 1 is a general diagram of a structure of an image forming apparatus including a fixing device according to Exemplary Embodiment 1 of the disclosure.
Figure 2:
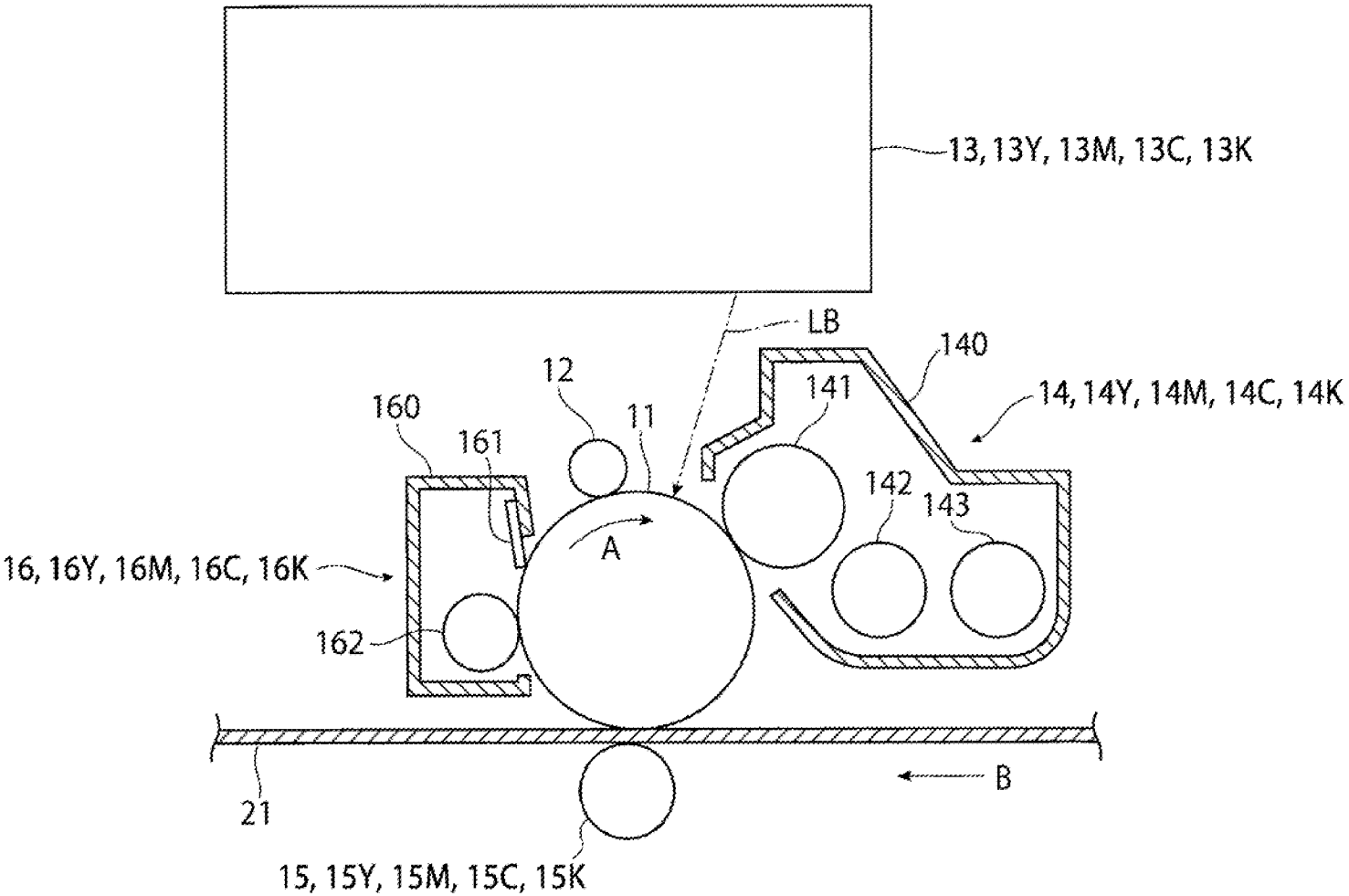
FIG. 2 is a diagram of an image forming device of an image forming apparatus including a fixing device according to Exemplary Embodiment 1 of the disclosure.

FIG. 1 is a general diagram of a structure of an image forming apparatus including a fixing device according to Exemplary Embodiment 1 of the disclosure. FIG. 2 is a diagram of an image forming device of the image forming apparatus. In the drawings, X denotes the width direction parallel to the horizontal direction, Y denotes the depth direction parallel to the horizontal direction, and Z denotes the vertical direction.

General Structure of Image Forming Apparatus

An example of an image forming apparatus 1 according to Exemplary Embodiment 1 is a color printer. As illustrated in FIG. 1, the image forming apparatus 1 includes multiple image forming devices 10 forming toner images developed with toner forming a developer, an intermediate transfer device 20 that holds the toner images formed by the image forming devices 10 and transports the toner images to a second transfer position where the toner images are finally second-transferred to a recording sheet 5, serving as an example of a recording medium, a sheet feeder 30 that accommodates and transports intended recording sheets 5 to be fed to the second transfer position of the intermediate transfer device 20, and a fixing device 40 that fixes the toner images on the recording sheet 5 second-transferred by the intermediate transfer device 20 to the recording sheet 5. As illustrated in FIG. 1, the image forming apparatus 1 includes a device body 1*a*. The device body 1*a* includes a support structure member and an outer covering. A chain double-dashed line in the drawing indicates a related transport path in the device body 1*a* along which the recording sheet 5 is transported. In Exemplary Embodiment 1, the multiple image forming devices 10 and the intermediate transfer device 20 form an image forming unit that forms images on the recording sheets 5.

The image forming devices 10 include four image forming devices 10Y, 10M, 10C, and 10K that respectively form toner images of yellow (Y), magenta (M), cyan (C), and black (K). These four image forming devices 10Y, 10M, 10C, and 10K are aligned in the horizontal direction in the internal space of the device body 1*a*.

The four image forming devices 10 include the image forming devices 10Y, 10M, 10C, and 10K for yellow (Y), magenta (M), cyan (C), and black (K). As illustrated in FIG. 2, the image forming devices 10Y, 10M, 10C, and 10K each include a rotatable photoconductor drum 11 serving as an image carrier. Around the photoconductor drum 11, the following devices are arranged as examples of a toner image forming unit. The devices include a charging device 12, an exposure device 13, a developing device 14Y, 14M, 14C, or 14K, a first transfer device 15Y, 15M, 15C, or 15K, and a drum cleaner 16Y, 16M, 16C, or 16K. The charging device 12 charges, at a predetermined potential, a circumferential surface (image carrying surface) of the photoconductor drum 11 that enables image formation. The exposure device 13 irradiates the circumferential surface charged by the photoconductor drum 11 with light based on image information (signal) to form an electrostatic latent image (for the corresponding color) with a potential difference. The developing device 14Y, 14M, 14C, or 14K develops the electrostatic latent image with toner of the developer for the corresponding color (Y, M, C, or K) to form a toner image. The first transfer device 15Y, 15M, 15C, or 15K serves as an example of a first transfer unit that transfers the toner image to the intermediate transfer device 20. The drum cleaner 16Y, 16M, 16C, or 16K removes accretions such as toner remaining on and adhering to the image carrying surface of the photoconductor drum 11 after first transfer to clean the photoconductor drum 11.

The photoconductor drum 11 is formed from a grounded, hollow or solid cylindrical base member having a circumferential surface on which an image carrying surface including a photosensitive layer formed from a photosensitive material is formed. The photoconductor drum 11 is supported to rotate in the direction of arrow A in response to receipt of power from a driving device, not illustrated.

The charging device 12 is formed from a contact charging roller disposed to be in contact with the photoconductor drum 11. A charging voltage is fed to the charging device 12. When a developing device 14 performs reversal development, a voltage or current with the polarity the same as that with which toner provided by the developing device 14 is charged is fed as the charging voltage. Alternatively, a non-contact charging device such as a scorotron disposed over the surface of the photoconductor drum 11 without being in contact with the surface may be used as an example of the charging device 12.

An example used as the exposure device 13 is a device that performs deflection scanning in the axial direction of the photoconductor drum 11 with a laser beam LB based on image information input to the image forming apparatus 1. Alternatively, the exposure device 13 may be formed from a LED print head that includes light emitting diodes (LEDs), serving as light emitting devices, arranged in the axial direction of the photoconductor drum 11 to irradiate the photoconductor drum 11 with light based on the image information to form an electrostatic latent image.

Each developing device 14Y, 14M, 14C, or 14K includes a housing 140, a development roller 141, two agitation transporters 142 and 143, and a thickness regulator, not illustrated. The development roller 141 holds the developer inside the housing 140 having an opening and a developer chamber, and transports the developer to a development area opposing the photoconductor drum 11. The agitation transporters 142 and 143 are, for example, screw augers that transport the developer through the development roller 141 while agitating the developer. The thickness regulator regulates the amount (layer thickness) of the developer held on the development roller 141. A development voltage is applied to the developing device 14 across the development roller 141 and the photoconductor drum 11 from a power supply not illustrated. The development roller 141 and the agitation transporters 142 and 143 rotate in a predetermined direction in response to receipt of power transmitted from a driving device not illustrated. As an example of the developers for the above four colors, a binary developer including non-magnetic toner and magnetic carrier is used.

The first transfer device 15Y, 15M, 15C, or 15K is a contact transfer device that includes a first transfer roller disposed around the photoconductor drum 11 while being in contact with the photoconductor drum 11 with an intermediate transfer belt 21 interposed therebetween and receives a first transfer voltage. An example of the first transfer voltage is a direct current voltage with a polarity opposite to that with which toner is charged, fed from a power supply not illustrated.

A drum cleaner 16 includes a container body 160 that is partially open, a cleaning board 161 disposed to be in contact with the circumferential surface of the photoconductor drum 11 after first transfer with a predetermined pressure to remove accretions such as remaining toner to clean the photoconductor drum 11, and a let-off member 162 formed from, for example, a screw auger that collects accretions such as toner removed by the cleaning board 161 and transports the accretions toward a collection system not illustrated.

As illustrated in FIG. 1, the intermediate transfer device 20 is disposed below, in the vertical direction Z, each of the image forming devices 10Y, 10M, 10C, and 10K. The intermediate transfer device 20 includes the intermediate transfer belt 21, multiple belt support rollers 22 to 26, a second transfer device 27, and a belt cleaner 28. The intermediate transfer belt 21 rotates in the direction of arrow B while passing first transfer positions between the photoconductor drum 11 and first transfer devices 15 (first transfer rollers). The belt support rollers 22 to 26 are disposed on the inner side of the intermediate transfer belt 21 to hold the intermediate transfer belt 21 in a desired state and to rotatably support the intermediate transfer belt 21. The second transfer device 27 is an example of a second transfer unit that is disposed at a portion on the outer circumferential surface (image carrying surface) of the intermediate transfer belt 21 supported by the belt support roller 26, and second-transfers the toner images on the intermediate transfer belt 21 to the recording sheets 5. The belt cleaner 28 removes accretions such as toner or paper dust remaining on and adhering to the outer circumferential surface of the intermediate transfer belt 21 after passing the second transfer device 27 to clean the intermediate transfer belt 21.

An example usable as the intermediate transfer belt 21 is an endless belt made of a material formed by dispersing a resistance regulator such as carbon black in a synthetic resin such as polyimide resin or polyamide resin. The belt support roller 22 is formed as a driving roller that is driven to rotate by a driving device not illustrated. The belt support rollers 23 and 24 are formed as figuring rollers that form an image forming surface of the intermediate transfer belt 21. The belt support roller 25 is formed as a tensioning roller that exerts tension on the intermediate transfer belt 21. The belt support roller 26 is formed as a back surface support roller for second transfer. The belt support roller 22 also functions as an opposing roller opposing the belt cleaner 28.

The second transfer device 27 is a contact transfer device that includes a second transfer roller to which a second transfer voltage is applied and that rotates while being in contact with the circumferential surface of the intermediate transfer belt 21 at a second transfer position. The second transfer position is a portion of the outer circumferential surface of the intermediate transfer belt 21 supported by the belt support roller 26 of the intermediate transfer device 20. A direct current voltage with a polarity opposite to or the same as that with which toner is charged is fed as a second transfer voltage from a power supply not illustrated to the second transfer device 27 or the belt support roller 26 of the intermediate transfer device 20.

As illustrated in FIG. 1, the fixing device 40 includes a roller-shaped or belt-shaped heating rotator 41 and a roller-shaped or belt-shaped pressing rotator 42 inside a device housing 43 serving as a device body having an inlet port and an outlet port for the recording sheets 5. The heating rotator 41 rotates in the direction of arrow C and is heated by a heating unit to keep the surface temperature at a predetermined temperature. The pressing rotator 42 is driven to rotate while being in contact with the heating rotator 41 with a predetermined pressure while extending substantially in the axial direction of the heating rotator 41. In the fixing device 40, a contact portion at which the heating rotator 41 and the pressing rotator 42 are in contact serves as a fixing nip N where a predetermined fixing operation (heating and pressing) is performed. The fixing device 40 also integrally includes a decurler 60, which corrects curls of the recording sheet 5 subjected to fixing by the heating rotator 41 and the pressing rotator 42. The structure of the fixing device 40 will be described in detail, below.

The sheet feeder 30 is disposed below the intermediate transfer device 20. The sheet feeder 30 includes one or more sheet containers 31 each of which accommodates a stack of recording sheets 5 of an intended size or type, and a pick-up device 32 that picks up the recording sheets 5 one by one from the corresponding sheet container 31. The sheet container 31 is attached to allow a user of the device body 1*a* to pull out the sheet container 31 to, for example, the front (near side in the Y direction in the drawing), which is the side where the user faces in operation.

Examples of the recording sheet 5 include sheets for use in an electrophotographic photocopying machine or printer, such as ordinary sheets, thin sheets such as tracing paper, thick sheets, and OHP sheets. To further improve the smoothness of image surfaces after fixing, the surface of the recording sheet 5 is preferably as smooth as possible. For example, a thick paper sheet with a relatively large basis weight, such as a coated sheet obtained by coating the surface of an ordinary sheet with resin or art paper for printing is preferably usable.

Between the sheet feeder 30 and the second transfer device 27, one or more pairs of sheet transport rollers 33 and 34 that transport the recording sheet 5 fed from the sheet feeder 30 to the second transfer position and a fed-sheet transport path 35 formed with a transport guide not illustrated are disposed. The pair of sheet transport rollers 34 disposed on the fed-sheet transport path 35 immediately in front of the second transfer position function as, for example, registration rollers that adjust the timing for transporting the recording sheets 5. Between the second transfer device 27 and the fixing device 40, a sheet transport path 37 is disposed. The sheet transport path 37 includes a transport belt 36 to transport the second-transferred recording sheet 5 fed from the second transfer device 27 to the fixing device 40. In addition, a discharge transport path 39 including a pair of sheet discharging rollers 38 is also formed at a portion near the sheet outlet port in the device body 1*a*. The sheet discharging rollers 38 discharge the recording sheets 5 subjected to fixing and transported from the fixing device 40 to a sheet discharge portion, not illustrated, on the side surface of the device body 1*a*.

In the image forming apparatus 1 with the above structure, the fed-sheet transport path 35 including the pairs of sheet transport rollers 33 and 34, the second transfer device 27, the sheet transport path 37 including the transport belt 36, and the fixing device 40 are integrally attached to form a sheet transport unit 300, which is drawable frontward with respect to the device body 1*a* of the image forming apparatus 1 via guide rails, not illustrated.

When a transport error of the recording sheet 5 occurs in the image forming apparatus 1, at any of the fed-sheet transport path 35 including the pairs of sheet transport rollers 33 and 34, the second transfer device 27, the sheet transport path 37 including the transport belt 36, and the fixing device 40, the sheet transport unit 300 is drawn to the front from the device body 1*a*.

When the sheet transport unit 300 is drawn to the front, the components of the image forming apparatus 1 including the fed-sheet transport path 35 including the pairs of sheet transport rollers 33 and 34, the second transfer device 27, the sheet transport path 37 including the transport belt 36, and the fixing device 40 are exposed to the outside, to enable removal of the recording sheet 5 that has caused a transport error.

In FIG. 1, a controller 100 generally controls the operation of the image forming apparatus 1. The controller 100 includes a central processing unit (CPU), a read only memory (ROM), a random access memory (RAM), a bus connecting these components such as the CPU and the ROM, and a communication interface. The CPU, the ROM, the RAM, the bus, and the communication interface are not illustrated.

Operation of Image Forming Apparatus

Hereinbelow, a basic image forming operation performed by the image forming apparatus 1 will be described.

Here, an operation in a full-color mode to form a full-color image by combining toner images of four colors (Y, M, C, and K) using the four image forming devices 10Y, 10M, 10C, and 10K will be described.

Upon receipt of command information requesting a full-color image forming operation (print) from a user interface or printer driver, not illustrated, components of the image forming apparatus 1 including the four image forming devices 10Y, 10M, 10C, and 10K, the intermediate transfer device 20, the second transfer device 27, and the fixing device 40 start operating.

As illustrated in FIGS. 1 and 2, in each of the image forming devices 10Y, 10M, 10C, and 10K, the photoconductor drum 11 rotates in the direction of arrow A, and the charging device 12 charges the surface of the photoconductor drum 11 with a predetermined polarity (negative polarity in Exemplary Embodiment 1) and a predetermined potential. Subsequently, the exposure device 13 irradiates the surface of the charged photoconductor drum 11 with light emitted based on an image signal obtained by converting the image information input to the image forming apparatus 1 into the corresponding color component (Y, M, C, or K) to form, on the surface, an electrostatic latent image of the corresponding color component formed from a predetermined potential difference.

Subsequently, each of the image forming devices 10Y, 10M, 10C, and 10K develops the electrostatic latent image of the corresponding color component formed on the photoconductor drum 11 by feeding toner of the corresponding color (Y, M, C, or K) charged by the predetermined polarity (negative polarity) from the development roller 141 and electrostatically attaching the toner to the electrostatic latent image. Through this development, the electrostatic latent image of the corresponding color component formed on each photoconductor drum 11 is then visualized as a toner image of any of the four colors (Y, M, C, and K) developed with toner of the corresponding color.

Subsequently, when the toner image of the corresponding color formed on the photoconductor drum 11 of each of the image forming devices 10Y, 10M, 10C, and 10K is transported to the first transfer position, the first transfer device 15Y, 15M, 15C, or 15K first-transfers the toner image of the corresponding color to the intermediate transfer belt 21 of the intermediate transfer device 20 rotating in the direction of arrow B so that the toner image is sequentially superposed on a previous toner image.

In each of the image forming devices 10Y, 10M, 10C, and 10K that has finished first transfer, the drum cleaner 16 scrapes accretions off the surface of the photoconductor drum 11 to clean the surface. Thus, each of the image forming devices 10Y, 10M, 10C, and 10K is prepared for the subsequent image forming operation.

Subsequently, the intermediate transfer device 20 holds the toner image first-transferred by the rotation of the intermediate transfer belt 21 to transport the toner image to the second transfer position. On the other hand, the sheet feeder 30 feeds an intended recording sheet 5 to the fed-sheet transport path 35 at the right timing for the image forming operation. On the fed-sheet transport path 35, the pair of sheet transport rollers 34 serving as registration rollers feed the recording sheet 5 to the second transfer position at the transfer timing.

At the second transfer position, the second transfer device 27 collectively second-transfers the toner images on the intermediate transfer belt 21 to the recording sheet 5. In the intermediate transfer device 20 that has finished second transfer, the belt cleaner 28 removes accretions such as toner remaining on the surface of the second-transferred intermediate transfer belt 21 to clean the intermediate transfer belt 21.

Subsequently, the recording sheet 5 to which the toner image has been second-transferred is removed from the intermediate transfer belt 21, and then transported to the fixing device 40 through the sheet transport path 37. In the fixing device 40, the recording sheet 5 subjected to second transfer is introduced into and caused to pass through the fixing nip N between the rotating heating rotator 41 and pressing rotator 42 to fix the unfixed toner image to the recording sheet 5 through an intended fixing process (heating and pressing), and to correct curls of the recording sheet 5 caused by the fixing process with the decurler 60. Lastly, the recording sheet 5 subjected to fixing is discharged by the pair of sheet discharging rollers 38 to a sheet discharge portion, not illustrated, disposed on the side surface of the device body 1*a*.

With the above operation, the recording sheet 5 carrying a full-color image formed by combining four-color toner images is output.

Structure of Fixing Device

Figure 3:
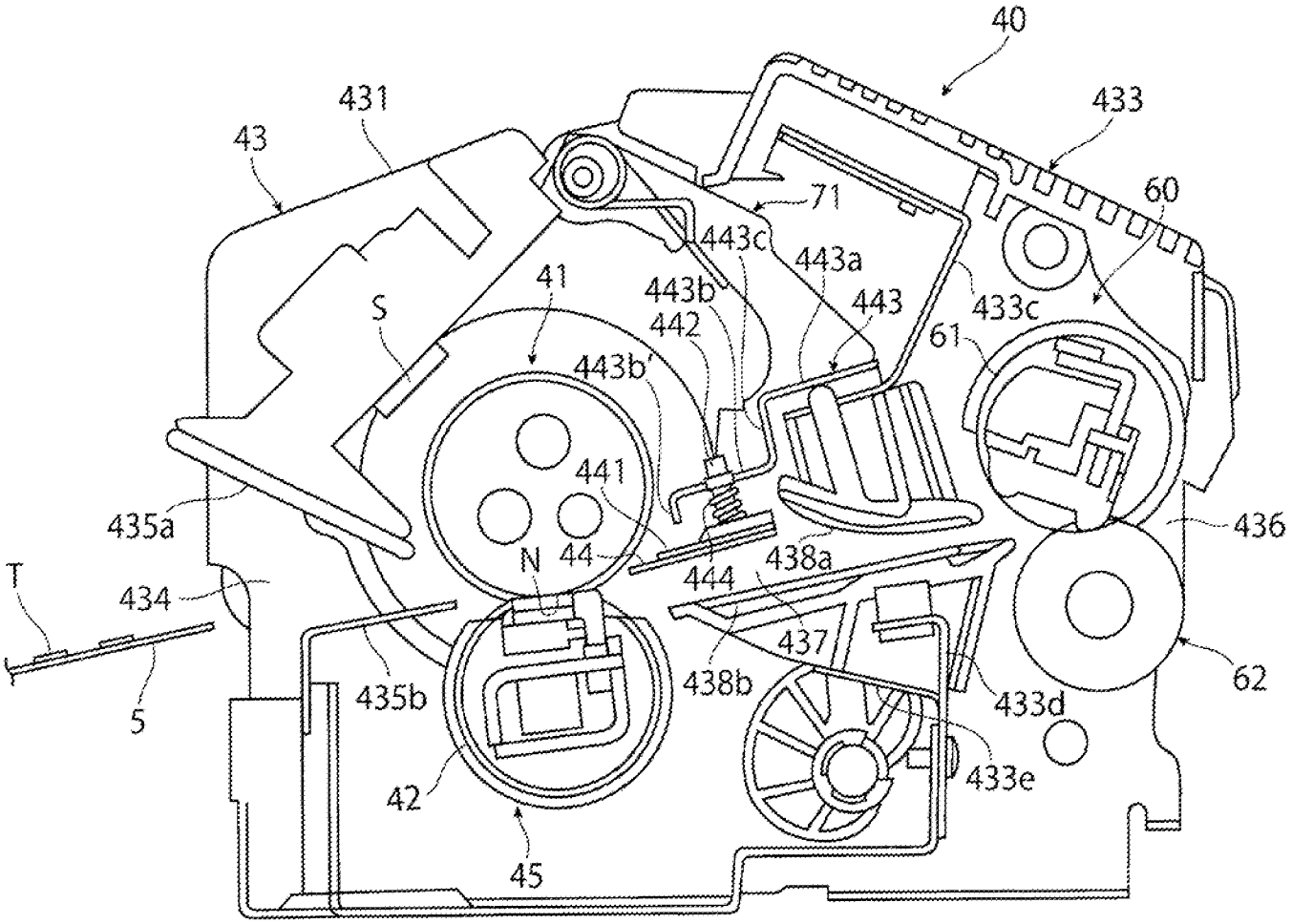
FIG. 3 is a cross-sectional view of a structure of the fixing device according to Exemplary Embodiment 1 of the disclosure.

FIG. 3 is a cross-sectional view of a structure of a fixing device according to Exemplary Embodiment 1. The fixing device 40 integrally includes the decurler 60.

As illustrated in FIG. 3, the fixing device 40 roughly includes the device housing 43, the heating roller 41, the pressing belt 42, a removal hook 44, a decurling belt 61, and a decurling roller 62. The device housing 43 is an example of a device body of the fixing device 40. The heating roller 41 and the pressing belt 42 are disposed inside the device housing 43 as an example of a fixing unit to perform a fixing process on the recording sheet 5. The heating roller 41 serves as a heating rotator, and the heating roller 41 serves as a pressing rotator. The removal hook 44 is integrally installed inside the device housing 43, and is an example of a removal assistance unit to help removal of the recording sheet 5 from the heating roller 41. The decurling belt 61 and the decurling roller 62 are integrally installed inside the device housing 43 as an example of a pair of decurling units that correct curling by holding the recording sheet 5 therebetween. The decurling belt 61 serves as a first decurling rotator, and the decurling roller 62 serves as a second decurling rotator.

Instead of the heating roller 41, the heating rotator may be an endless belt. Instead of the pressing belt 42, the pressing rotator may be a roller.

Instead of the decurling belt 61, the first decurling rotator may be a roller. Instead of the decurling roller 62, the second decurling rotator may be an endless belt.

Figure 4:
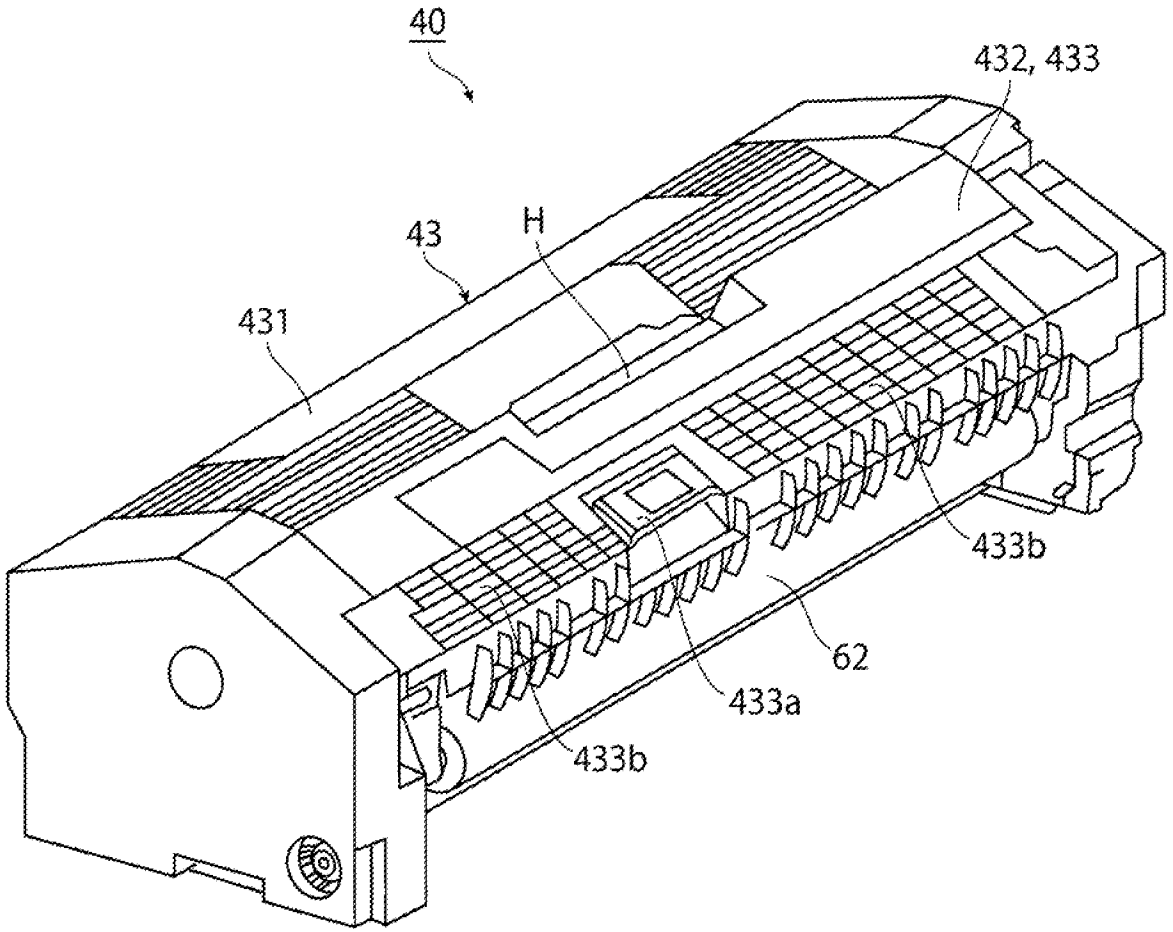
FIG. 4 is a perspective view of a structure of a device housing of the fixing device according to Exemplary Embodiment 1 of the disclosure.

As illustrated in FIG. 4, the device housing 43 has a shape of a thin long box with substantially pentagonal side surfaces. The device housing 43 includes multiple frames formed from, for example, metal sheets, and an enclosure formed from, for example, a synthetic resin covering the outer peripheries of the multiple frames.

The device housing 43 includes, on the upper end surface, a first inclined surface 431 and a second inclined surface 432. The first inclined surface 431 is disposed on the upstream side in the transport direction of the recording sheet 5, to be inclined while having the downstream end portion in the transport direction of the recording sheet 5 located higher in the vertical direction. The second inclined surface 432 is disposed on the downstream side in the transport direction of the recording sheet 5, to be inclined while having the downstream end portion in the transport direction of the recording sheet 5 located lower in the vertical direction. The second inclined surface 432 of the device housing 43 forms an open/close covering 433, serving as an example of an open/close unit disposed to enable opening and closing of the device housing 43. The open/close covering 433 includes an operation handle 433*a* that is operated to open or close the open/close covering 433. The operation handle 433*a* is attached on the front side in the longitudinal direction to be rotatable about a rotation shaft, which will be described later. The open/close covering 433 also includes a grid-like outlet port 433*b* through which air fed from below is discharged upward as needed to cool the decurler 60. A gripper H is disposed at the center of the upper end surface of the device housing 43 to allow the fixing device 40 to be gripped.

As illustrated in FIG. 3, the device housing 43 includes, on the left side, an inlet port 434 through which the recording sheet 5 to which an unfixed toner image T has been transferred is introduced. Inside the inlet port 434, an upper guide 435*a* and a lower guide 435*b* are disposed. The upper guide 435*a* and the lower guide 435*b* guide the recording sheet 5 to the fixing nip N where the heating belt 41 and the pressing roller 42 are in pressure contact with each other. The device housing 43 also includes, on the left side, an outlet port 436 through which the recording sheet 5 subjected to decurling with the decurling belt 61 and the decurling roller 62 is discharged to the outside. The device housing 43 includes, inside thereof, a transport path 437 for the recording sheet 5. The transport path 437 extends while being inclined from the inlet port 434 toward the outlet port 436 with the downstream side in the transport direction of the recording sheet 5 being located higher in the vertical direction. In addition, inside the device housing 43, an upper chute 438*a* and a lower chute 438*b* that guide both top and back surfaces of the recording sheet 5 are disposed between the heating roller 41 and the pressing belt 42 and the decurling belt 61 and the decurling roller 62. The upper chute 438*a* is attached via an attachment frame 433*c* fixed to the inner surface of the open/close covering 433 to be openable and closeable together with the open/close covering 433. The lower chute 438*b* is attached via attachment frames 433*d* and 433*e* fixed to the inside of the device housing 43. The recording sheet 5 is transported while having the center in the width direction that is along the surface and crossing the transport direction, using as a reference (that is, a center registration). A non-contact temperature sensor S in FIG. 3 detects the surface temperature of the heating roller 41.

Figure 5:
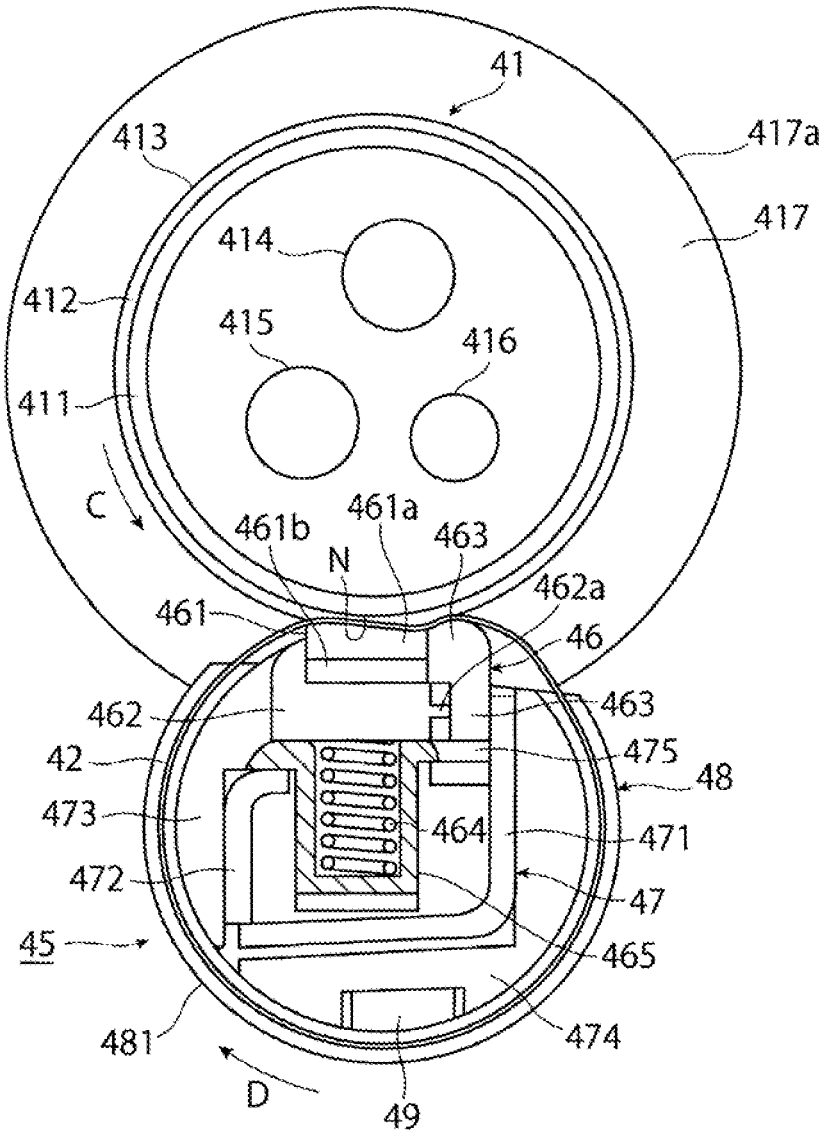
FIG. 5 is a cross-sectional view of a structure of a related portion of the fixing device according to Exemplary Embodiment 1 of the disclosure.

As illustrated in FIG. 5, the heating roller 41 includes a hollow cylindrical core 411 formed from a metal such as a stainless steel, aluminium, or iron (thin high-tensile strength steel pipe), an elastic layer 412 formed from a heat-resistant elastic material such as silicone rubber or fluoro-rubber covering the outer periphery of the core 411, and a release layer 413 formed from, for example, perfluoroalkoxy alkane (PFA) or polytetrafluoroethylene (PTFE) thinly coated on the surface of the elastic layer 412. Inside the heating roller 41, multiple (three, in the illustrated example) halogen lamps 414 to 416 are disposed to serve as examples of a heat source. The three halogen lamps 414 to 416 are individually or concurrently turned on in accordance with the size or type of the recording sheets 5. The core 411 of the heating roller 41 has both end portions in the axial direction rotatably supported via bearings 417, serving as examples of a bearing member attached to the frame of the device housing 43. Each bearing 417 has an outer circumferential surface 417*a* formed of an external cylinder formed from a metal hollow cylinder such as a stainless steel.

The heating roller 41 is driven to rotate in the direction of arrow C at a predetermined speed by a driving device (not illustrated) via a driving gear, not illustrated, formed from a helical gear attached to the rear end of the core 411 in the axial direction. The rotation speed of the heating roller 41 may be varied depending on, for example, the type of the recording sheet 5.

As illustrated in FIG. 3, on the outer circumferential surface of the heating roller 41, the removal hook 44 is disposed. The removal hook 44 prevents the recording sheet 5 from being wound around the outer circumferential surface of the heating roller 41, and helps removal of the recording sheet 5 from the surface of the heating roller 41. At the exit of the fixing nip N, the removal hook 44 has its far end opposing the surface of the heating roller 41 with a predetermined small gap interposed therebetween, and extends to be inclined at a predetermined angle with respect to the outer circumferential surface of the heating roller 41. The removal hook 44 is formed from a thin long rectangular metal flat board extending substantially throughout in the axial direction of the heating roller 41.

The removal hook 44 is attached to a bottom surface of a flat holding member 441, formed from a material such as a thermally resistant synthetic resin, by adhesion, screwing, or another method. On the upper end surface of the holding member 441, multiple mount portions 442 with a solid cylindrical shape protrude while being arranged at predetermined intervals in the longitudinal direction. Above the holding member 441, a mount member 443 made of a metal sheet with which the removal hook 44 is attached to the open/close covering 433 is disposed. The mount member 443 has a crank-shaped cross section including an upper horizontal board 443*a* and a lower horizontal board 443*b* vertically disposed to form a step, and a short vertical board 443*c* connecting the upper horizontal board 443*a* and the lower horizontal board 443*b* together. A far end 443*b*' of the lower horizontal board 443*b* of the mount member 443 is shortly bent downward. The multiple mount portions 442 of the holding member 441 are inserted into the lower horizontal board 443*b* of the mount member 443 to serve as stoppers. Thus, the holding member 441 is attached to the mount member 443 while being movable upward. Between the lower horizontal board 443*b* of the mount member 443 and the holding member 441, a coil spring 444 that enables upward shift (retreat) of the removal hook 44 is interposed.

As illustrated in FIG. 3, the pressing belt 42 forms a pressing unit 45, which is a unit integrated to hold the pressing belt 42 to press the pressing belt 42 against the heating roller 41.

As illustrated in FIG. 5, the pressing unit 45 includes the pressing belt 42, a pressing member 46 disposed inside the pressing belt 42 and serving as an example of a presser unit that brings the pressing belt 42 into pressure contact with the surface of the heating roller 41, a support member 47 disposed inside the pressing belt 42 and serving as an example of a support unit that supports the pressing member 46, guide members 48 serving as examples of a guide unit that rotatably guides both end portions of the heating belt 41 in the longitudinal direction, and a felt piece 49 disposed inside the pressing belt 42 and serving as an example of a lubricant holder that holds a lubricant applied to the inner circumferential surface of the pressing belt 42.

Figure 6:
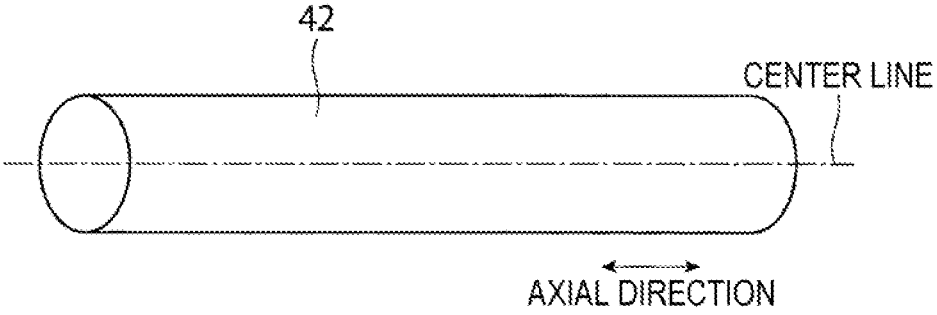
FIG. 6 is a perspective view of a structure of a pressing belt.
Figure 7:
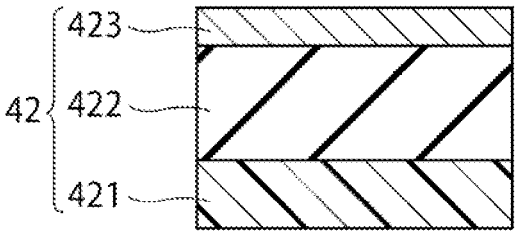
FIG. 7 is a cross-sectional view of a structure of a pressing belt.

As illustrated in FIG. 6, the pressing belt 42 is formed from an endless belt made of a flexible material, and has a shape of a thin hollow cylinder when free from tension before being attached. As illustrated in FIG. 7, the pressing belt 42 includes a base material layer 421, an elastic layer 422 coated on the surface of the base material layer 421, and a release layer 423 coated on the surface of the elastic layer 422. The pressing belt 42 may alternatively include a base material layer 421 and a release layer 423 coated on the surface of the base material layer 421. The base material layer 421 is formed from a thermally resistant synthetic resin such as polyimide, polyamide, or polyimide-amide. The elastic layer 422 is formed from an elastic material such as a thermally resistant silicone rubber or fluoro-rubber. The release layer 423 is formed from a material such as perfluoroalkoxy alkane (PFA) or polytetrafluoroethylene (PTFE). The pressing belt 42 has a thickness of, for example, approximately 50 to 200 μm.

The pressing belt 42 is driven to rotate in the direction of arrow D by being brought into pressure contact with the heating roller 41.

As illustrated in FIG. 5, the pressing member 46 is a member for bringing the pressing belt 42 into pressure contact with the heating roller 41. The pressing member 46 includes a pad member 461, a pad support member 462, and a pressure member 463. The pad member 461 comes into contact with the inner circumferential surface of the pressing belt 42 to bring the pressing belt 42 into pressure contact with the heating roller 41. The pad support member 462 supports the pad member 461. The pressure member 463 presses the pressing belt 42 against the heating roller 41 at the exit of the fixing nip N to deform the elastic layer 412 of the heating roller 41 into a concave shape, and to remove the recording sheet 5 from the surface of the heating roller 41 with the solidity of the recording sheet 5 itself.

The pad member 461 includes a first pad member 461*a* and a second pad member 461*b*. The first pad member 461*a* has a substantially rectangular cross section and is formed from silicone rubber or acrylonitrile rubber foam that forms the fixing nip N. The second pad member 461*b* is formed from a metal mount that supports the first pad member 461*a*. The first pad member 461*a* is fastened to the second pad member 461*b* with, for example, an adhesive.

The pad support member 462 has a substantially L-shaped cross section formed from, for example, thermally resistant synthetic resin. The pad support member 462 also includes a protrusion 462*a* that holds the pressure member 463 on the downstream end surface in the rotation direction of the pressing belt 42. The pad support member 462 is elastically supported by multiple (for example, ten) coil springs 464 arranged in the longitudinal direction of the pressing belt 42. The coil springs 464 are supported by a support cylinder 465 attached to the support member 47.

The pressure member 463 has a substantially inverted-L-shaped cross section formed from, for example, thermally resistant synthetic resin. The pressure member 463 is held between the support member 47 and the protrusion 462*a* of the pad support member 462, and has its lower end portion supported by a short flat support board 475 fastened to the support member 47 by, for example, welding or pressure bonding.

As illustrated in FIG. 5, the support member 47 supports the pressing member 46 brought into pressure contact with the heating roller 41 with the pressing belt 42 interposed therebetween. The support member 47 may have any structure that has such solidity as to act against the reaction force from the heating roller 41. In the support member 47 according to Exemplary Embodiment 1, first and second support members 471 and 472 formed from two metal sheets with a substantially L-shaped cross section are combined and fixed to have a substantially rectangular cross section. The first and second support members 471 and 472 are fixed with both end portions 471*a* and 472*a* in the longitudinal direction being fitted to the guide members 48 (refer to FIG. 9). Holding members 473 and 474 that rotatably hold the inner circumferential surface of the pressing belt 42 are attached to the first and second support members 471 and 472. The support cylinder 465 that supports the coil springs 464 are integrated with, for example, the holding member 473.

The guide members 48 are disposed on both end portions of the pressing belt 42 in the axial direction. The guide members 48 are integrally formed from, for example, thermally resistant synthetic resin. As illustrated in FIG. 5, each guide member 48 includes a flange 481 with a substantially disk shape having an outer diameter larger than the outer diameter of the pressing belt 42, a guide portion, not illustrated, that has a short hollow cylinder shape on the inner surface of the flange 481 and rotatably guides the end portion of the pressing belt 42, attachment portions 482 (refer to FIG. 8) disposed to protrude on left and right sides of the flange 481, and a fixing portion 483 (refer to FIG. 9) disposed on the outer side of the flange 481 and having a substantially rectangular shape when viewed from a side.

Figure 8:
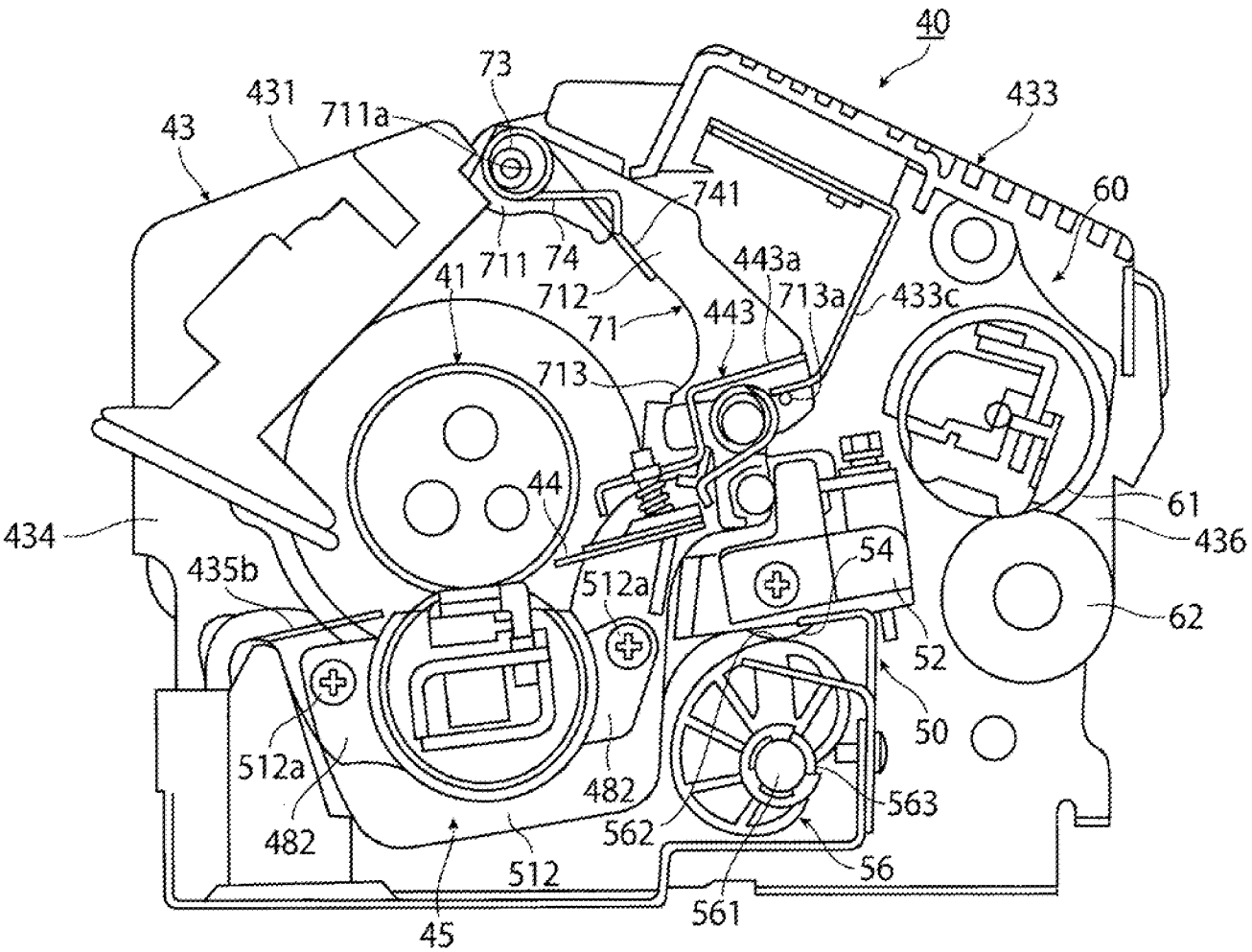
FIG. 8 is a cross-sectional view of a structure of the fixing device according to Exemplary Embodiment 1 of the disclosure.
Figure 9:
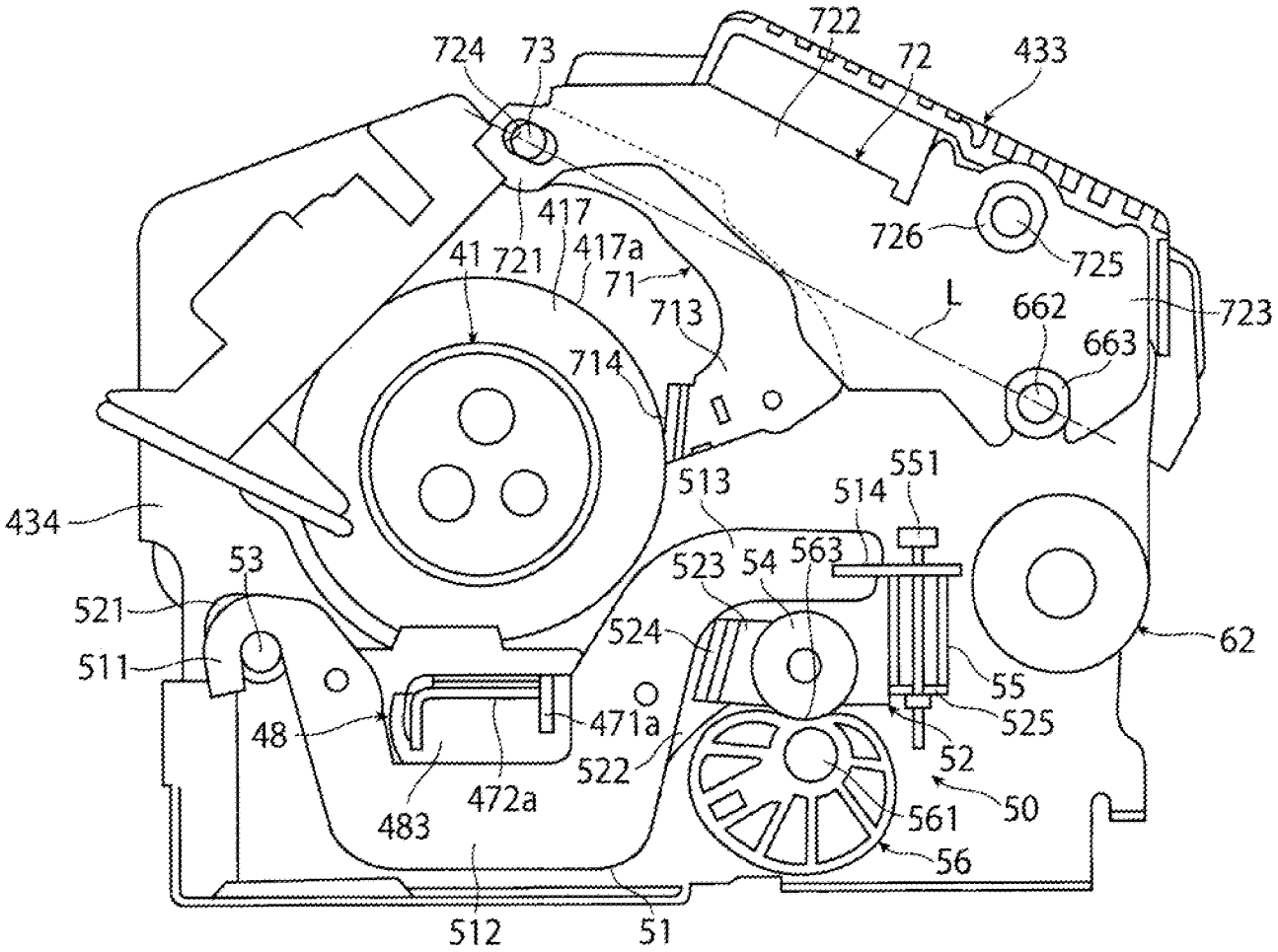
FIG. 9 is a cross-sectional view of a structure of the fixing device according to Exemplary Embodiment 1 of the disclosure.

As illustrated in FIGS. 8 and 9, while the fixing portion 483 of the guide member 48 with a rectangular shape when viewed from a side is fixed to an intermediate portion 512 of a pressing arm 51, the attachment portions 482 are screwed on and attached to the pressing arm 51 with screws 512*a*.

As illustrated in FIG. 5, the felt piece 49 has a thin long rectangular cross section substantially throughout the pressing belt 42. The felt piece 49 is disposed at a recess in the lower end surface of the holding member 474 with, for example, adhesion. The felt piece 49 is impregnated with a predetermined amount of a lubricant that is to be fed in the state of being applied to the inner circumferential surface of the pressing belt 42. The lubricant reduces the sliding resistance between the pressing belt 42 and the pressing member 46. Examples usable as the lubricant include amino-denatured silicone oil with a viscosity of 100 to 350 cs. The felt piece 49 is impregnated with the lubricant in advance to apply the lubricant to the inner circumferential surface of the pressing belt 42. However, this is not the only possible form. The lubricant may be fed while being applied to the inner circumferential surface of the pressing belt 42 at the early period.

As illustrated in FIGS. 8 and 9, the pressing unit 45 is movable toward and away from the heating roller 41 by a retract mechanism 50. The retract mechanism 50 includes the pressing arms 51 that are rotatable about a support shaft 53, serving as an example of a support point, and to which the pressing unit 45 is attached, and action arms 52 that are similarly rotatable about the support shaft 53 and from which a pressing force is exerted on the pressing arms 51. The pressing arms 51 are disposed on both end portions of the pressing belt 42 in the axial direction. The action arms 52 are disposed on the inner side of and adjacent to the pressing arms 51 in the axial direction of the pressing belt 42.

Each pressing arm 51 is formed from, for example, a flat metal sheet with a predetermined thickness. The pressing arm 51 includes a substantially inverted-U-shaped base end portion 511 disposed at the inlet port 434 of the device housing 43 and rotatably supported by the support shaft 53 disposed at the base end portion of the lower guide 435*b*, the intermediate portion 512 that has a substantially inverted-angular-C-shape when viewed from a side and that holds the pressing unit 45, and a far end portion 513 disposed at the right upper end portion of the intermediate portion 512 to extend in substantially the horizontal direction.

As illustrated in FIG. 8, the left and right attachment portions 482 of the guide member 48 constituting the pressing unit 45 are fastened to the intermediate portion 512 of the pressing arm 51 with the screws 512*a*. The pressing belt 52 is brought into pressure contact with the surface of the heating roller 41 with a predetermined pressing force via the support member 47 and the pressing member 46 when the pressing unit 45 and the pressing arms 51 move upward together.

Each action arm 52 has a substantially similar figure to the pressing arm 51. The action arm 52 includes a base end portion 521 rotatably supported by the support shaft 53, an intermediate portion 522 with a substantially inverted-angular-C-shape when viewed from a side, and a far end portion 523 disposed at the right upper end portion of the intermediate portion 522 to extend in substantially the horizontal direction.

As illustrated in FIG. 9, the far end portion 523 of the action arm 52 is located below the far end portion 513 of the pressing arm 51 with a bent portion 524 interposed therebetween. The far end portion 523 of the action arm 52 is bifurcated to be parallel to the far end portion 513 of the pressing arm 51. Between the bifurcated portions of the far end portion 523 of the action arm 52, a disk-shaped cam follower 54 is rotatably attached.

Between the far end portion 513 of the pressing arm 51 and the far end portion 523 of the action arm 52, a pressing spring 55 that exerts a pressing force on the pressing arm 51 is interposed. At the far end portion 513 of the pressing arm 51, a support board 514 that supports the upper end portion of the pressing spring 55 is disposed by, for example, welding. At the far end portion 523 of the action arm 52, a support board 525 that supports the lower end portion of the pressing spring 55 is integrally disposed while being bent to have a substantially inverted-angular-C-shaped cross section. Between the support board 514 of the pressing arm 51 and the support board 525 of the action arm 52, an adjusting bolt 551 that adjusts the pressing force of the pressing spring 55 is attached.

Below the cam follower 54 of the action arm 52, a first eccentric cam 56 is rotatably disposed. The first eccentric cam 56 is disposed to be rotatable about a rotation shaft 561. The first eccentric cam 56 has an eccentric, substantially oval shape with a pressing portion 562 with a largest diameter and a derepression portion 563 with a smallest diameter connected with a smoothly curved surface. The rotation shaft 561 of the first eccentric cam 56 is driven to rotate in the clockwise and counterclockwise directions with a driving motor, not illustrated, disposed on the back surface of the device housing 43 to switch the pressing belt 42 between the state of being brought into pressure contact with the heating roller 41 with a predetermined pressing force and a pressure release state of being spaced apart from the heating roller 41 (refer to FIG. 9). When the derepression portion 563 of the first eccentric cam 56 rotates to the position opposing the cam follower 54, each pressing arm 51 retracts to a lower derepression position with its weight together with the action arm 52. In the derepression position, the pressing belt 42 may not be spaced apart from the surface of the heating roller 41 as long as the pressing belt 42 and the heating roller 41 are not pressed against each other.

The fixing device 40 with the above structure heats and presses the recording sheet 5 with the heating roller 41 and the pressing belt 42, to fix the unfixed toner image T onto the recording sheet 5 that passes the fixing nip N. When the recording sheet 5 to which the unfixed toner image T is to be fixed passes the fixing nip N, the recording sheet 5 curls due to various factors including the material of the recording sheet 5, the area of the unfixed toner image T to be fixed to the recording sheet 5, and the thickness of the toner layer. In the fixing device 40, when, for example, the recording sheet 5 formed from a thick paper sheet passes the fixing nip N, the recording sheet 5 may curl to protrude downward. In the fixing device 40, when, for example, the recording sheet 5 formed from an ordinary sheet or a thin paper sheet such as tracing paper passes the fixing nip N, the recording sheet 5 may curl to protrude upward.

Figure 10:
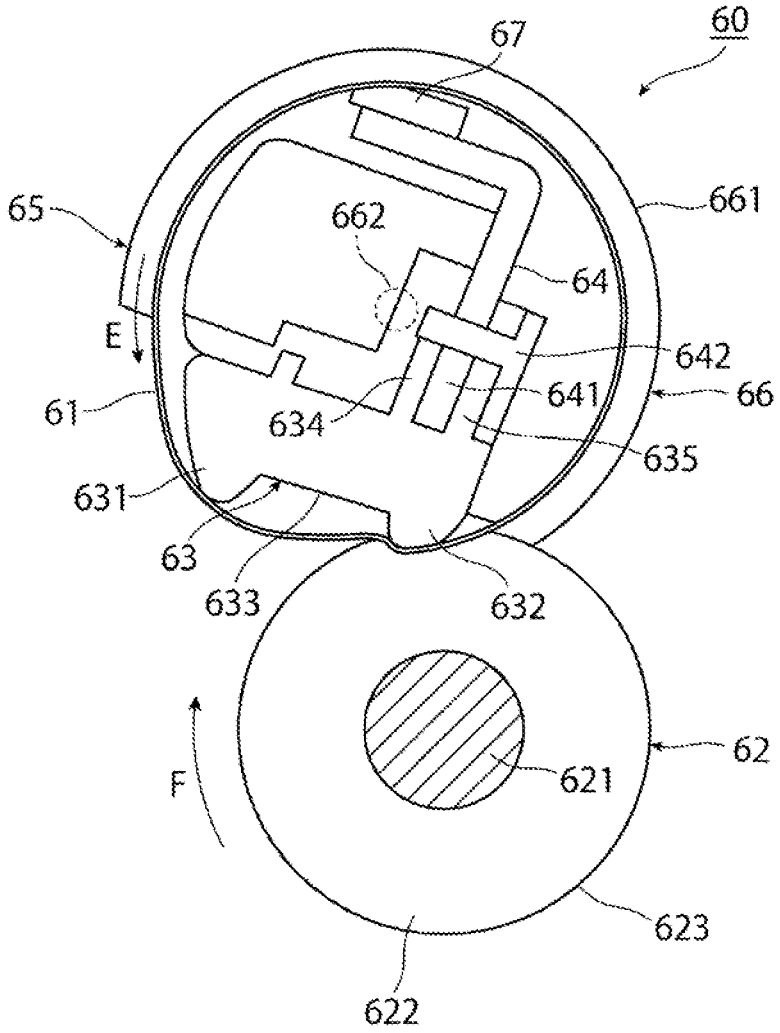
FIG. 10 is a cross-sectional view of a structure of a decurler.

As illustrated in FIG. 10, the decurler 60 includes the decurling belt 61 and the decurling roller 62. The decurling belt 61 comes into contact with the top surface of the recording sheet 5 carrying a toner image to correct a curl of the recording sheet 5. The decurling roller 62 comes into contact with the back surface of the recording sheet 5 to correct a curl of the recording sheet 5. The decurler 60 is capable of correcting curls of the recording sheet 5 with the decurling belt 61 and the decurling roller 62, which form a pair of decurling units, on both cases where the recording sheet 5 curls to protrude downward and upward.

The decurling belt 61 is an endless belt that corrects curling by causing the recording sheet 5 to pass between itself and the decurling roller 62, and includes a pressure contact member 63 inside. The pressure contact member 63 is supported by a support frame 64, serving as an example of a support unit having a solid surface facing away from the decurling roller 62. The pressure contact member 63 serves as an example of a pressure contact unit that is brought into pressure contact with the decurling roller 62.

The decurling belt 61 together with the components disposed inside, such as the pressure contact member 63 and the support frame 64, forms a correction belt unit 65. The correction belt unit 65 includes the decurling belt 61, the pressure contact member 63 disposed inside the decurling belt 61 to bring the decurling belt 61 into pressure contact with the surface of the decurling roller 62, the support frame 64 that supports the pressure contact member 63, a pair of guide members 66, serving as examples of a guide unit that rotatably guides both ends of the decurling belt 61 in the longitudinal direction, and a felt piece 67 disposed inside the decurling belt 61 and serving as an example of a lubricant holder that holds a lubricant applied to the inner circumferential surface of the decurling belt 61.

Figure 11:
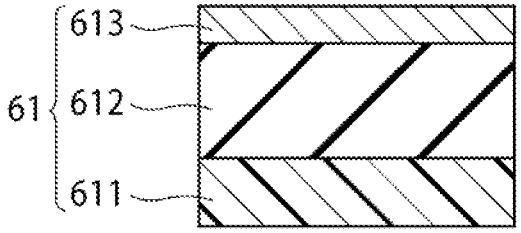
FIG. 11 is a cross-sectional view of a structure of a decurling belt.

Similarly to the pressing belt 42, the decurling belt 61 is formed from an endless belt made of a flexible material, and has a shape of a thin hollow cylinder when free from tension before being attached. As illustrated in FIG. 11, the decurling belt 61 includes a base material layer 611, an elastic layer 612 coated on the surface of the base material layer 611, and a release layer 613 coated on the surface of the elastic layer 612. The decurling belt 61 may alternatively include a base material layer 611 and a release layer 613 coated on the surface of the base material layer 611. The base material layer 611 is formed from, for example, a thermally resistant synthetic resin such as polyimide, polyamide, or polyimide-amide. The elastic layer 612 is formed from a thermally resistant elastic material such as silicone rubber or fluororubber. The release layer 613 is formed from a material such as perfluoroalkoxy alkane (PFA) or polytetrafluoroethylene (PTFE). The decurling belt 61 has a thickness of, for example, approximately 50 to 200 μm.

The decurling belt 61 is driven to rotate in the direction of arrow E by being brought into pressure contact with the decurling roller 62.

As illustrated in FIG. 10, the pressure contact member 63 has a thick flat plate shape made of, for example, a thermally resistant synthetic resin. The pressure contact member 63 includes, on the lower end surface, a curved downward first protrusion 631 disposed on the upstream side in the transport direction of the recording sheet 5, a curved downward second protrusion 632 disposed on the downstream side in the transport direction of the recording sheet 5, and a flat portion 633 extending between the first protrusion 631 and the second protrusion 632. The second protrusion 632 protrudes by an amount the same as or larger than the first protrusion 631.

On the back surface of the pressure contact member 63, a pair of attachment boards 634 and 635 stand erect upward. To the attachment boards 634 and 635, the support frame 64 is attached to be fixed at the downstream end portion in the transport direction of the recording sheet 5.

The support frame 64 is formed from, for example, a metal sheet having a predetermined thickness and bent to have a substantially L-shaped cross section. A lower end portion 641 of the support frame 64 is fastened with a screw 642 while being held between the attachment boards 634 and 635 of the pressure contact member 63.

The guide member 66 is attached while being fastened to both end portions of the support frame 64 in the longitudinal direction. The guide member 66 is integrally formed by a material such as a thermally resistant synthetic resin. As illustrated in FIG. 10, the guide member 66 includes a flange 661, a guide portion not illustrated, and a rotation shaft 662. The flange 661 has a substantially disk shape with an outer diameter larger than the outer diameter of the decurling belt 61. The guide portion has a short hollow cylinder shape and is disposed on the inner surface of the flange 661 to rotatably guide the end of the decurling belt 61. The rotation shaft 662 is formed from, for example, a metal cylinder embedded to protrude outward at the center of the outer surface of the flange 661.

As illustrated in FIG. 9, in the correction belt unit 65, the rotation shaft 662 of the guide member 66 is rotatably attached to a second support arm 72 with a bearing member 663 interposed therebetween.

As illustrated in FIG. 10, the felt piece 67 has a thin long rectangular cross section substantially throughout the decurling belt 61. The felt piece 67 is disposed on the upper end surface of the support frame 64 by, for example, adhesion. The felt piece 67 is impregnated with a predetermined amount of a lubricant that is to be fed in the state of being applied to the inner circumferential surface of the decurling belt 61. The lubricant reduces the sliding resistance between the decurling belt 61 and the pressure contact member 63. Examples usable as the lubricant include amino-denatured silicone oil with a viscosity of 100 to 350 cs. The felt piece 67 is impregnated with the lubricant in advance to apply the lubricant to the inner circumferential surface of the decurling belt 61. However, this is not the only possible form. The lubricant may be fed while being applied to the inner circumferential surface of the decurling belt 61 at the early period.

Figure 12:
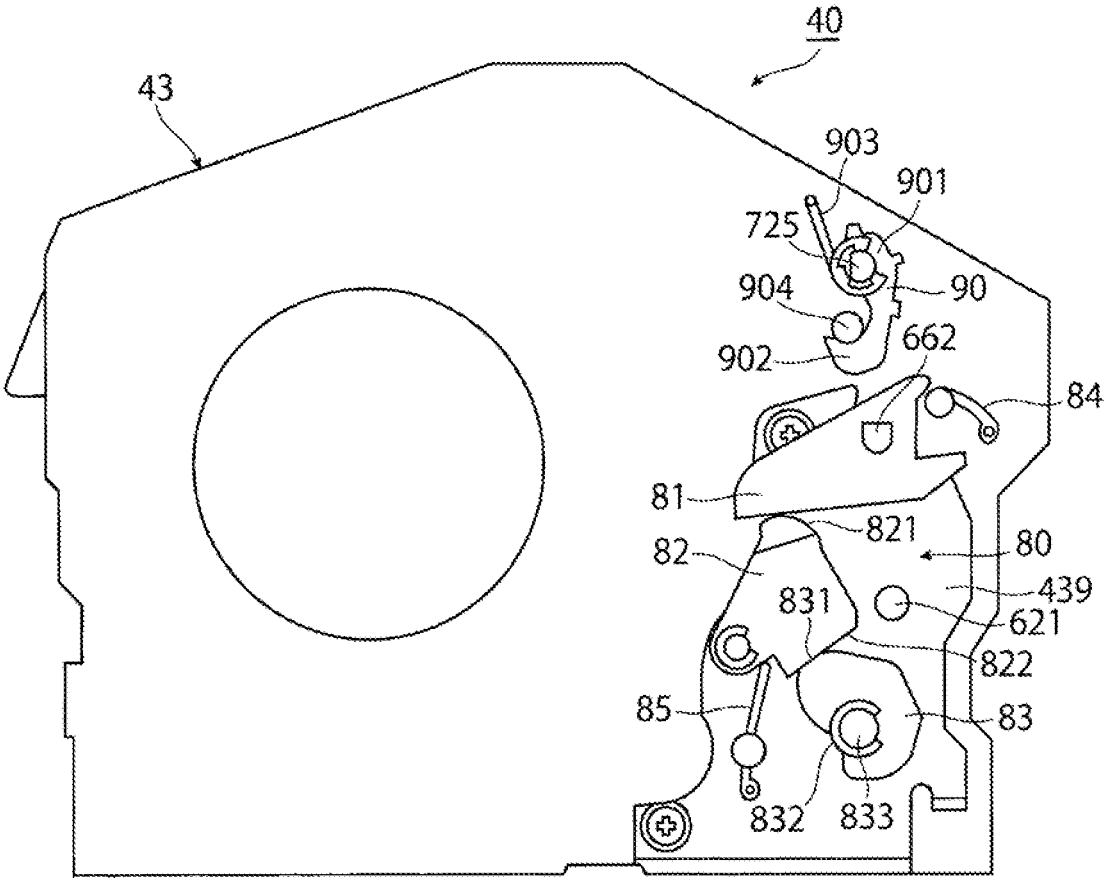
FIG. 12 is a side view of a structure of a switching mechanism of a decurler.
Figure 13:
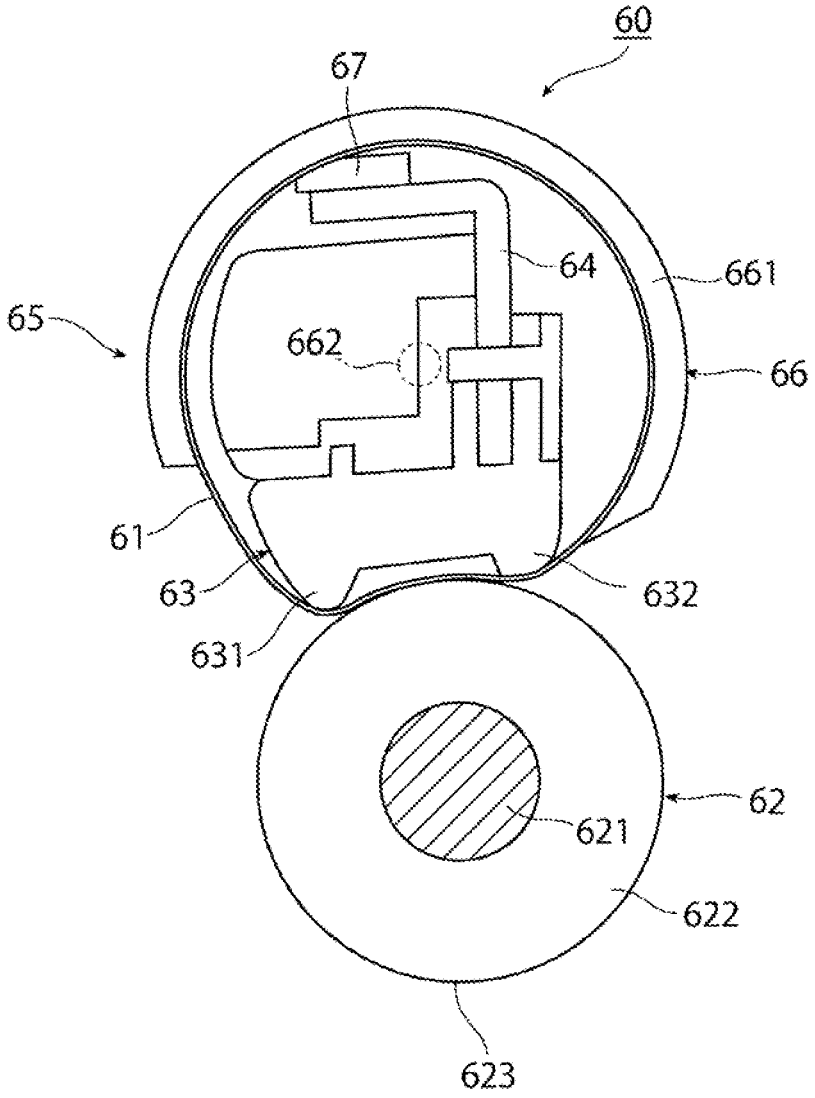
FIG. 13 is a cross-sectional view of a structure of the decurler in a second position.

As illustrated in FIG. 12, the correction belt unit 65 is switchable by a switching mechanism 80 between the states of being brought into pressure contact with and removed from the decurling roller 62 by being rotated about the rotation shaft 662. Swing arms 81 are attached while being fastened to both end portions of the rotation shaft 662 of the correction belt unit 65 in the axial direction while having a substantially D shape when viewed from the side. When rotated about the rotation shaft 662, the correction belt unit 65 is switchable between a first position and a second position. As illustrated in FIG. 10, in the first position, the second protrusion 632 of the pressure contact member 63 digs into the surface of the decurling roller 62 with a relatively large contact pressure force. As illustrated in FIG. 13, in the second position, the first and second protrusions 631 and 632 of the pressure contact member 63 are in contact with the surface of the decurling roller 62 with a relatively small contact pressure force with the decurling belt 61 interposed therebetween or oppose the surface of the decurling roller 62 with a gap interposed therebetween.

When rotated to the first position, in the correction belt unit 65, the second protrusion 632 is brought into pressure contact with the surface of the decurling roller 62 to dig into the surface of the decurling roller 62 with a relatively large contact pressure force with the decurling belt 61 interposed therebetween, and corrects the recording sheet 5 curling to protrude upward and passing between the decurling belt 61 and the decurling roller 62 into a flat shape.

When rotated to the second position, in the correction belt unit 65, the first and second protrusions 631 and 632 come into contact with the surface of the decurling roller 62 with a relatively small contact pressure force with the decurling belt 61 interposed therebetween, and corrects the recording sheet 5 curling to protrude downward and passing between the decurling belt 61 and the decurling roller 62 into a flat shape.

As illustrated in FIG. 12, the switching mechanism 80 includes a swing arm 81 having a substantially triangular shape when viewed from a side, an intermediate cam 82 that rotates the swing arm 81 by coming into contact with the far end portion of the swing arm 81, and a second eccentric cam 83 that rotates the intermediate cam 82. The swing arm 81 is attached to the correction belt unit 65 while being fixed at an end portion of the rotation shaft 662 of the guide member 66. A portion of the swing arm 81 near the base end portion having a substantially triangular shape when viewed from a side is fixed to the rotation shaft 662 of the guide member 66. The swing arm 81 is urged by a spring 84 to rotate in the counterclockwise direction. When viewed from a side, the intermediate cam 82 is formed into a substantially trapezoidal shape including a curved portion 821 that comes into contact with the swing arm 81 and a straight portion 822 that comes into contact with the second eccentric cam 83. The intermediate cam 82 is urged by a spring 85 to rotate in the clockwise and to come into contact with the second eccentric cam 83. The second eccentric cam 83 has a substantially oval shape with a first pressing portion 831 with a largest diameter and a second pressure contact portion 832 with a smallest diameter connected with a smoothly curved surface. When a rotation shaft 833 of the second eccentric cam 83 is driven to rotate by a driving motor, not illustrated, disposed on the front surface of the device housing 43, the second eccentric cam 83 switches the decurling belt 61 between a first position at which the decurling belt 61 is brought into pressure contact with the decurling roller 62, and a second position at which the decurling belt 61 is brought into contact with the decurling roller 62 with a small force.

Figure 14:
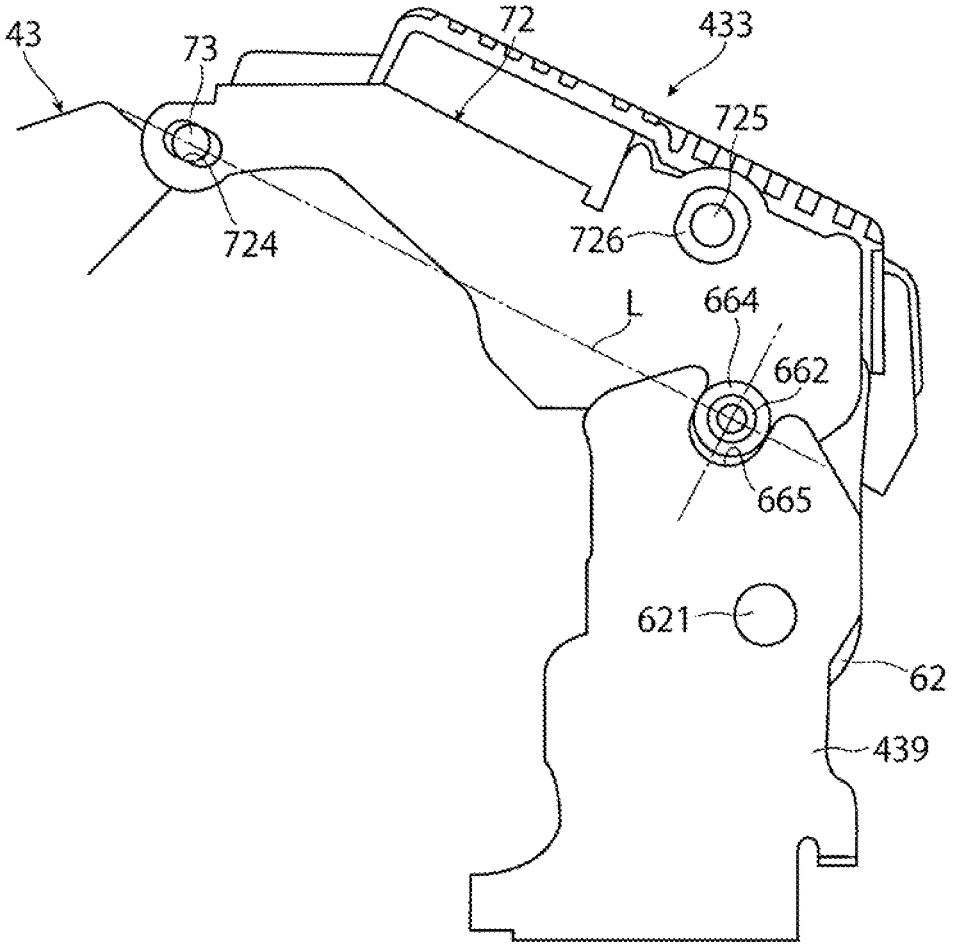
FIG. 14 is a cross-sectional view of a structure of a related portion of a positioning mechanism of a second support arm of the fixing device according to Exemplary Embodiment 1 of the disclosure.

As illustrated in FIG. 10, the decurling roller 62 includes a metal core 621 with a cylinder shape, an elastic layer 622 formed from a foaming or non-foaming elastic material and relatively thickly coated on the outer circumferential surface of the core 621, and a release layer 623 coated on the surface of the elastic layer 622. The core 621 of the decurling roller 62 is rotatably attached to a frame of the device housing 41. The decurling roller 52 is driven to rotate in the direction of arrow F by a driving device not illustrated disposed on the front surface of the device housing 43. As illustrated in FIG. 14, the core 621 of the decurling roller 62 has both end portions in the axial direction rotatably attached to side frames 439 disposed on both end portions of the device housing 43 in the longitudinal direction.

As illustrated in FIG. 3, in the fixing device 40 with the above structure, the heating roller 41 and the pressing belt 42, serving as examples of a fixing unit, the removal hook 44 that assists removal of the recording sheet 5 from the heating roller 41, and the decurler 60 that corrects curling of the curled recording sheet 5 by performing a fixing process on the recording sheet 5 are integrally formed in the device housing 43.

In the fixing device 40, a transport error or jamming of the recording sheet 5 may occur at, for example, the exit of the fixing nip N where the heating roller 41 and the pressing belt 42 are in pressure contact with each other, or between the fixing nip N and the decurler 60. Unlike existing fixing devices, in the fixing device 40, the exit of the fixing nip N and the area between the fixing nip N and the decurler 60 are disposed at a deep portion inside the device housing 43. Thus, the fixing device 40 may hinder removal of the recording sheet 5 that has caused a transport error from the inlet port 434 or the outlet port 436 of the device housing 43 by simply releasing the pressure exerted between the heating roller 41 and the pressing belt 42 and releasing the pressure exerted between the decurling belt 61 and the decurling roller 62 of the decurler 60.

Thus, the fixing device according to Exemplary Embodiment 1 includes an open/close unit that is openable and closable with respect to the device body, and that separates, when opened, the removal assistance unit from the fixing unit and one of the decurling units from the other.

In the fixing device 40 according to Exemplary Embodiment 1, the open/close unit includes first and second support units that support the removal assistance unit and one of the decurling units to be rotatable about the same support point or different support points. When the open/close unit is closed, the first and second support units are fixed in different positions.

In other words, as illustrated in FIGS. 8 and 9, the fixing device 40 according to Exemplary Embodiment 1 includes a first support arm 71 and a second support arm 72. The first support arm 71 is an example of the first support unit that supports both end portions of the mount member 443 in the longitudinal direction to which the removal hook 44 is attached. The second support arm 72 is an example of the second support unit that rotatably supports both end portions of the decurling belt 61 in the longitudinal direction. The first and second support arms 71 and 72 are attached to be rotatable about the same support point or different support points of the device housing 43.

As illustrated in FIG. 9, in Exemplary Embodiment 1, the first and second support arms 71 and 72 are attached to be rotatable about the same support shaft 73 as an example of the support point. At the upper end portion of the device housing 43, the support shaft 73 protrudes inward from the inner surfaces of the inner frame at both ends of the device housing 43 in the longitudinal direction.

The second support arm 72 is attached while being fixed to the inner surfaces of both end portions of the open/close covering 433 in the longitudinal direction. The open/close covering 433 is opened and closed about the support shaft 73 via the second support arm 72.

As illustrated in FIG. 8, the first support arm 71 is formed from, for example, a metal sheet with a predetermined thickness and a substantially L shape when viewed from a side. The first support arm 71 includes a base end portion 711 rotatably supported by the support shaft 73 with a circular support hole 711*a* interposed therebetween, an intermediate portion 712 extending obliquely downward from the base end portion 711, and a far end portion 713 disposed at the lower end portion of the intermediate portion 712 to protrude toward the heating roller 41. A far end portion 741 of a spring 74 wound around the support shaft 73 is locked on the intermediate portion 712 of the first support arm 71. The first support arm 71 is urged by the spring 74 to rotate in the counterclockwise direction. The upper horizontal board 443*a* of the mount member 443 is attached to the far end portion 713 of the first support arm 71.

As illustrated in FIG. 9, a first positioning portion 714 is disposed on the far end portion 713 of the first support arm 71. The first positioning portion 714 fixes the position of the heating roller 41 while allowing the first positioning portion 714 to hit against the outer circumferential surface of the bearing 417 that rotatably supports the heating roller 41. The first positioning portion 714 is formed by bending the far end portion 713 of the first support arm 71 outward in the axial direction of the heating roller 41 into a substantially L shape.

When the open/close covering 433 is closed, the first positioning portion 714 of the first support arm 71 comes into contact with the outer circumferential surface 417*a* of the bearing 417 to be stopped and fixed in position. Both end portions of the heating roller 41 in the axial direction are rotatably supported by the bearing 417. Thus, when the position of the first support arm 71 is fixed by the bearing 417, the removal hook 44 that assists removal of the recording sheet 5 from the surface of the heating roller 41 opposes the outer circumferential surface of the heating roller 41 with a predetermined small gap interposed therebetween, and is accurately fixed in position to form a predetermined angle.

As illustrated in FIG. 8, when the open/close covering 433 is closed, a pin 713*a* at the far end portion 713 of the first support arm 71 is in contact with the lower end portion of the attachment frame 433*c* fixed to the inner surface of the open/close covering 433. The first support arm 71 rotates in the open and close directions about the support shaft 73, that is different from the shaft about which the open/close covering 433 rotates. When the pin 713*a* at the far end portion 713 comes into contact with the lower end portion of the attachment frame 433*c* of the open/close covering 433, the first support arm 71 is rotated in the open and close directions together with the open/close covering 433.

As illustrated in FIG. 9, the second support arm 72 is formed from, for example, a metal sheet with a predetermined thickness. The second support arm 72 includes a base end portion 721 rotatably supported by the support shaft 73, an intermediate portion 722 bent obliquely downward after extending in the horizontal direction from the base end portion 711, and a substantially rectangular far end portion 723 disposed on the side of the intermediate portion 722. The base end portion 721 of the second support arm 72 is rotatably supported by the support shaft 73 through a long hole 724. The long hole 724 has an oval shape that is long in a long axis direction extending in a straight line L connecting the support shaft 73 to the rotation shaft 662 of the decurling belt 61, and has an opening width corresponding to the outer diameter of the support shaft 73 in the short axis direction crossing the long axis direction. Thus, the second support arm 72 is attached to the support shaft 73 to be fixed in any position in the short axis direction while being movable in the long axis direction of the long hole 724.

A rotation shaft 725 is rotatably disposed at the far end portion 723 of the second support arm 72 via a bearing member 726. The rotation shaft 725 has an upper end portion, to which the operation handle 433*a* of the open/close covering 433 is rotatably attached. As described above, the bearing member 663 is attached to a lower end portion of the far end portion 723 of the second support arm 72. The bearing member 663 rotatably supports the rotation shaft 662 of the decurling belt 61.

As illustrated in FIG. 14, when the open/close covering 433 is closed, the second support arm 72 is fixed in position when a positioning roller 664 rotatably disposed on the rotation shaft 662 of the decurling belt 61 is fitted into a positioning portion 665, which is a groove formed in the assist frame 439 inside the device housing 43. The groove forming the positioning portion 665 has a substantially U shape extending in the direction crossing the straight line L connecting the support shaft 73 and the rotation shaft 662 of the decurling belt 61. When the positioning roller 664 is fitted into the positioning portion 665, the rotation shaft 662 of the decurling belt 61 is fixed in position in the direction along the straight line L connecting the support shaft 73 and the rotation shaft 662 of the decurling belt 61. The position of the rotation shaft 662 of the decurling belt 61 in the direction crossing the straight line L is fixed by the short axis direction of the long hole 724 formed in the base end portion 721 of the second support arm 72.

As illustrated in FIG. 12, the open/close covering 433 includes a stopper member 90 that holds the open/close covering 433 in the closed state. The stopper member 90 includes a base end portion 901 fixed to the rotation shaft 725 and a far end portion 902 having a substantially J shape when viewed from the side. The stopper member 90 is urged in the clockwise direction by a coil spring 903 wound around the rotation shaft 725. The far end portion 902 of the stopper member 90 is locked on a locking pin 904 disposed on the frame of the device housing 43. The open/close covering 433 is fixed in the closed position when the far end portion 902 of the stopper member 90 is locked on the locking pin 904.

As described above, the operation handle 433*a* (refer to FIG. 4) operated to open and close the open/close covering 433 is attached to and fixed to the rotation shaft 725. The open/close covering 433 is urged by a spring disposed on the base end portion 711 of the first support arm 71 in the opening direction. Thus, when the open/close covering 433 is closed, the far end portion 902 of the stopper member 90 is stopped while being locked on the locking pin 904 of the device housing 43.

Operation of Fixing Device

In the fixing device 40 according to Exemplary Embodiment 1, the fixing device 40 including the removal hook 44 and the decurler 60 that are integrated enables improvement in removal of the recording sheet 5 that has caused a transport error in the following manner.

Specifically, as illustrated in FIG. 3, when the fixing device 40 according to Exemplary Embodiment 1 fixes an unfixed toner image T onto the recording sheet 5, and corrects curls of the recording sheet 5 subjected to the fixing process with the decurler 60, a transport error (jamming) of the recording sheet 5 may occur.

In addition, as illustrated in FIG. 3, in the fixing device 40, a transport error so-called jamming of the recording sheet 5 may occur at the exit of the fixing nip N where the heating roller 41 and the pressing belt 42 are in pressure contact with each other, or between the fixing nip N and the decurler 60.

In the image forming apparatus 1 including the fixing device 40 according to Exemplary Embodiment 1, when a transport error of the recording sheet 5 occurs in the area of the fixing device 40, as illustrated in FIG. 1, the sheet transport unit 300 is drawn to the front to expose the fixing device 40 to the outside.

As illustrated in FIG. 4, in the fixing device 40, the operation handle 433*a* disposed on the second inclined surface 432 of the device housing 43 is rotated upward to rotate the stopper member 90 in the counterclockwise direction via the rotation shaft 725, as illustrated in FIG. 12. Thus, the locking pin 904 and the far end portion 902 of the stopper member 90 are disengaged from each other.

Figure 15:
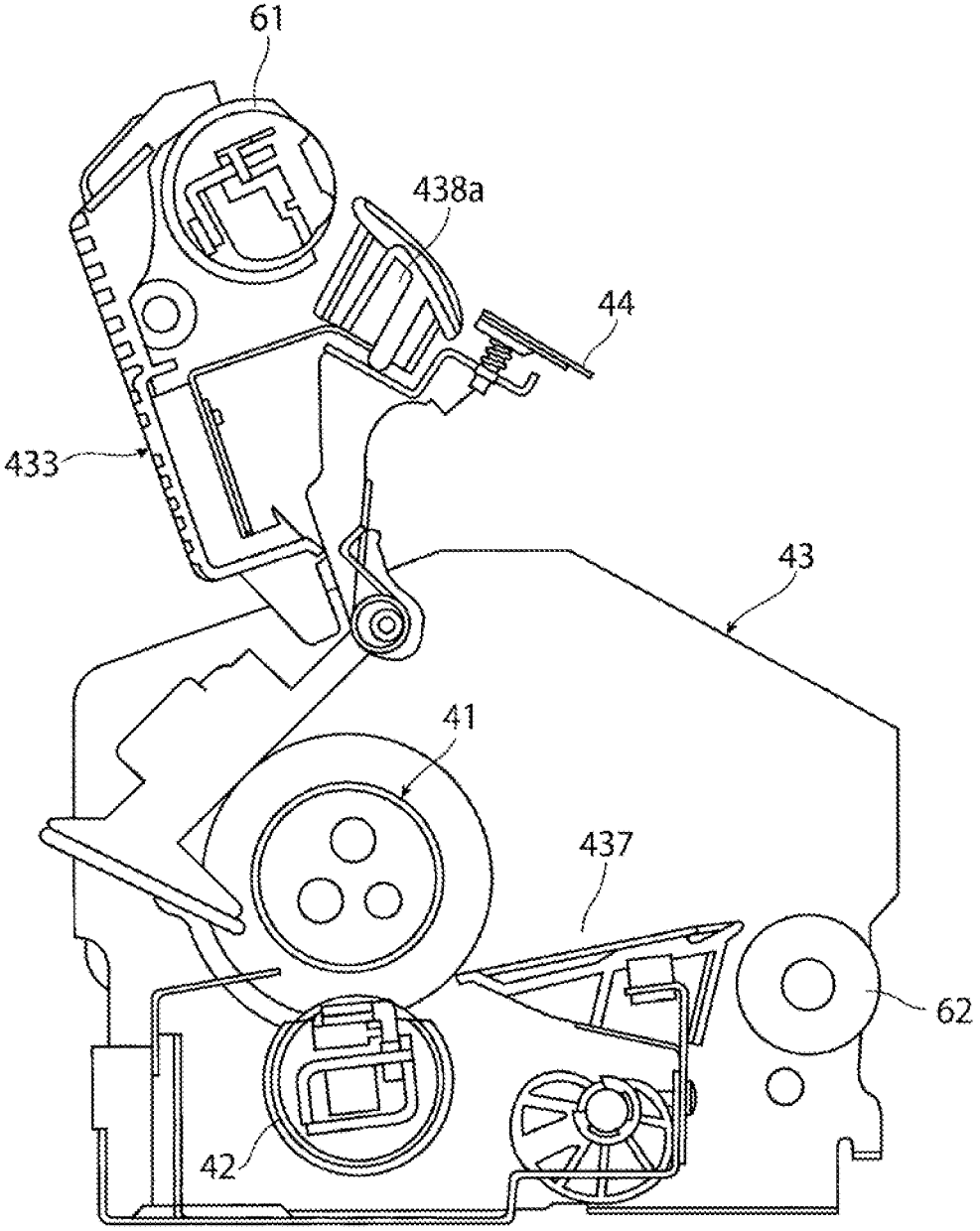
FIG. 15 is a cross-sectional view of a structure of the fixing device according to Exemplary Embodiment 1 of the disclosure where an open/close covering is open.

Then, as illustrated in FIG. 15, the fixing device 40 allows the open/close covering 433 to be opened and closed. When the open/close covering 433 is opened in the fixing device 40, the removal hook 44 attached to the open/close covering 433 via the first support arm is separated from the surface of the heating roller 41, and the decurling belt 61 attached to the second support arm 72 integrally disposed on the open/close covering 433 is separated from the decurling roller 62. Thus, the transport path 437 extending between the fixing nip N and the decurling belt 61 and the decurling roller 62 is exposed to the outside.

Thus, a user easily removes the recording sheet 5 that has caused a transport error on, for example, the transport path 437 extending between the fixing nip N and the decurling belt 61 and the decurling roller 62 from the fixing device 40 that is exposed to the outside and in which the open/close covering 433 is opened in the sheet transport unit 300 drawn out to the front of the device body 1*a*.

Thereafter, in the fixing device 40 from which the recording sheet 5 that has caused a transport error has been removed, the user closes the open/close covering 433, and the sheet transport unit 300 is retracted to the predetermined operation position in the device body 1*a*.

Here, as illustrated in FIG. 12, when the open/close covering 433 of the fixing device 40 is closed, the stopper member 90 of the open/close covering 433 is locked on the locking pin 904 of the device housing 43, and the open/close covering 433 is fixed in a predetermined closed position with respect to the device housing 43.

As illustrated in FIG. 9, when the open/close covering 433 of the fixing device 40 is fully closed, the positioning portion 714 disposed at the far end portion 713 of the first support arm 71 is fixed in position while being in contact with the outer circumferential surface 417*a* of the bearing 417 that rotatably supports the heating roller 41. Thus, the removal hook 44 attached to the far end portion 713 of the first support arm 71 opposes the surface of the heating roller 41 rotatably attached via the bearing 417 with a small gap interposed therebetween, and is accurately positioned at the operation position while being inclined by a predetermined angle with respect to the heating roller 41.

As illustrated in FIG. 14, in the fixing device 40, when the open/close covering 433 is completely closed, the rotation shaft 662 of the decurling belt 61 disposed at the far end portion 723 of the second support arm 72 is positioned while being fitted into the positioning portion 665, formed from a groove in the frame 439 of the device housing 43.

Here, the base end portion 721 of the second support arm 72 is rotatably supported by the support shaft 73 of the device housing 43 through the long hole 724. The groove forming the positioning portion 665 has a substantially U shape extending in the direction crossing the straight line L connecting the support shaft 73 and the rotation shaft 662 of the decurling belt 61. Thus, the rotation shaft 662 of the decurling belt 61 is accurately positioned with respect to the frame 439 of the device housing 43 to which the decurling roller 62 is rotatably attached. Thus, the decurler 60 keeps the decurling belt 61 and the decurling roller 62 in a predetermined pressure contact state, and exerts an intended decurling effect.

As illustrated in FIG. 15, in the image forming apparatus 1 including the fixing device 40 having the above structure, the fixing device 40 including the removal hook 44 and the decurler 60 integrated with each other enables improvement in removal of the recording sheet 5 that has caused a transport error.

As illustrated in FIGS. 8 and 9, in the fixing device 40, when the open/close covering 433 is closed after the removal of the recording sheet 5 that has caused a transport error, the removal hook 44 attached to the first support arm 71 is accurately positioned with respect to the heating roller 41.

In the fixing device 40, when the open/close covering 433 is closed, the decurling belt 61 attached to the second support arm 72 is accurately positioned with respect to the decurling roller 62. Thus, the fixing device 40 exerts an intended decurling performance.

The above exemplary embodiment has described an image forming apparatus that forms full-color images as an example of the image forming apparatus. However, this is not the only possible structure. The image forming apparatus may naturally be an apparatus that forms monochrome images.

The above exemplary embodiment has described a case where the first support arm 71 and the second support arm 72 are rotatably supported by the same support shaft 73. However, this is not the only possible structure. The first support arm 71 and the second support arm 72 may be attached to be rotatable about different support points. For example, the second support arm 72 may be supported to be rotatable about the support shaft 73, and the first support arm 71 may be supported to be rotatable about a support shaft different from the support shaft 73 of the device housing 43. Alternatively, the first support arm 71 may be rotatably attached to the second support arm 72.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a device body;

a fixing unit that is disposed on the device body to perform a fixing operation on a recording medium, and includes a removal assistance unit to assist removal of the recording medium;

a pair of decurling units disposed on the device body to correct a curl of the recording medium by holding the recording medium therebetween; and an open/close unit openably and closeably disposed on the device body to separate, when opened, the removal assistance unit from the fixing unit and one of the decurling units from the other decurling unit, wherein the open/close unit includes a first support arm and a second support arm that support the removal assistance unit and one of the decurling units to be rotatable about an identical support point, and wherein the identical support point is disposed on an upstream side in a transport direction of the recording medium and above the fixing unit.

2. The fixing device according to claim 1, wherein, when the open/close unit is closed, the first support arm and the second support arm are fixed in different positions.

3. The fixing device according to claim 2, wherein the first support arm and the second support arm are supported by the device body to be rotatable about the identical support point.

4. The fixing device according to claim 3, wherein the fixing unit includes a heating rotator rotatably held by a bearing member, and wherein the first support arm is fixed in position while having a far end of the first support arm hitting against an outer circumferential surface of the bearing member.

5. The fixing device according to claim 2, wherein the second support arm is fixed in position while having a support shaft that supports one of the decurling units hitting against the device body.

6. The fixing device according to claim 1, wherein the fixing unit, the removal assistance unit, and the pair of decurling units are integrally disposed in the device body, and wherein the open/close unit is formed from an open/close covering that openably and closeably covers upper portions of the removal assistance unit and the pair of decurling units.

7. An image forming apparatus, comprising:

an image forming unit that forms an image on a recording medium; and a fixing unit that fixes the image on the recording medium, wherein the fixing device according to claim 1 serves as the fixing unit.

8. A fixing device comprising:

a device body;

fixing means for performing a fixing operation on a recording medium, the fixing means being disposed on the device body and including removal assistance means for assisting removal of the recording medium using the removal assistance means;

a pair of decurling means for correcting a curl of the recording medium by holding the recording medium therebetween, the decurling means being disposed on the device body; and open/close means for separating, when opened, the removal assistance means from the fixing means and one of the decurling means from the other decurling means, the open/close means being openably and closeably disposed on the device body, wherein the open/close means includes a first support unit and a second support unit that support the removal assistance means and one of the decurling means to be rotatable about an identical support point, and wherein the identical support point is disposed on an upstream side in a transport direction of the recording medium and above the fixing means.

* * * * *